US011446801B2

(12) United States Patent
Aizawa et al.

(10) Patent No.: US 11,446,801 B2
(45) Date of Patent: Sep. 20, 2022

(54) DRIVER

(71) Applicant: KOKI HOLDINGS CO., LTD., Tokyo (JP)

(72) Inventors: Sotaro Aizawa, Ibaraki (JP); Yoshiichi Komazaki, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 327 days.

(21) Appl. No.: 16/608,064

(22) PCT Filed: Mar. 30, 2018

(86) PCT No.: PCT/JP2018/013674
§ 371 (c)(1),
(2) Date: Oct. 24, 2019

(87) PCT Pub. No.: WO2018/198672
PCT Pub. Date: Nov. 1, 2018

(65) Prior Publication Data

US 2020/0189080 A1 Jun. 18, 2020

(30) Foreign Application Priority Data

Apr. 28, 2017 (JP) ..... JP2017-089451

(51) Int. Cl.
*B25C 1/04* (2006.01)
*B25C 1/06* (2006.01)

(52) U.S. Cl.
CPC ..... *B25C 1/047* (2013.01); *B25C 1/06* (2013.01)

(58) Field of Classification Search
CPC ..... B25C 1/047; B25C 1/06; B25C 1/005; B25C 1/04
See application file for complete search history.

(56) References Cited

U.S. PATENT DOCUMENTS 3,589,588 A 6/1971 Vasku
3,920,169 A * 11/1975 DeCaro ..... B25C 1/005 227/120
4,442,965 A * 4/1984 Leistner ..... B25C 1/003 227/136
5,332,141 A * 7/1994 Mukoyama ..... B25C 1/003 227/136

(Continued)

FOREIGN PATENT DOCUMENTS

JP 61-005867 B2 2/1986
JP H04-037735 Y 9/1992

(Continued)

OTHER PUBLICATIONS

Decision of Dismissal of Amendment issued in corresponding Japanese Patent Application No. 2019-515181, dated Oct. 26, 2021 w/English Translation.

(Continued)

*Primary Examiner* — Anna K Kinsaul
*Assistant Examiner* — Himchan Song
(74) *Attorney, Agent, or Firm* — McDermott Will & Emery LLP

(57) ABSTRACT

A driver capable of improving a timing of feeding of a fastener to an injection unit is provided. In a driver including an injection unit to which a fastener is fed, and a striking unit configured to strike the fastener of the injection unit when moving from a first position to a second position, the driver further includes: an operational member operated by an operator; moving mechanisms that stop and move the striking unit when the operational member is operated; a feeder that feeds the fastener to the injection unit; and a power mechanism that stops the feeder during a period of stoppage of the striking unit and that moves the feeder to feed the fastener to the injection unit during a period from start of movement of the striking unit by the operation of the operational member to a moment before the striking of the fastener.

12 Claims, 21 Drawing Sheets

10 IMPACT TOOL
12 STRIKING UNIT
15, 46 MOVING MECHANISM
19 POWER MECHANISM
37 INJECTION UNIT
55 FASTENER
62 FEEDER

(56) References Cited

U.S. PATENT DOCUMENTS

| | | | | |
|---|---|---|---|---|
| 7,225,962 | B2 * | 6/2007 | Porth | B25C 5/1627 227/135 |
| 8,684,245 | B2 * | 4/2014 | Canlas, Jr. | B25C 1/005 227/8 |
| 2007/0108250 | A1 | 5/2007 | Odoni et al. | |
| 2010/0258608 | A1 * | 10/2010 | Porth | B25C 1/00 227/138 |
| 2011/0240709 | A1 * | 10/2011 | Oouchi | B25C 1/005 227/8 |
| 2016/0288305 | A1 | 10/2016 | McCardle et al. | |
| 2016/0325419 | A1 | 11/2016 | Sperrfechter et al. | |

FOREIGN PATENT DOCUMENTS

| | | | |
|---|---|---|---|
| JP | 2007-136662 | A | 6/2007 |
| JP | 2016-190277 | A | 11/2016 |
| JP | 2017-500215 | A | 1/2017 |
| JP | 6554254 | B2 | 7/2019 |

OTHER PUBLICATIONS

German Office Action issued in corresponding German Patent Application No. 112018002197.1, dated May 7, 2021, with English translation.

Japanese Notice of Reasons for Refusal issued in corresponding Japanese Patent Application No. 2019-515181, dated Oct. 6, 2020, with English Translation.

International Search Report issued in corresponding International Patent Application No. PCT/JP2018/013674, dated Jun. 5, 2018, with English translation.

* cited by examiner

| | | | |
|---|---|---|---|
| 10 | IMPACT TOOL | 37 | INJECTION UNIT |
| 12 | STRIKING UNIT | 55 | FASTENER |
| 15, 46 | MOVING MECHANISM | 62 | FEEDER |
| 19 | POWER MECHANISM | | |

DRIVER

CROSS REFERENCE

This application is the U.S. National Phase under 35 U.S.C. § 371 of International Application No. PCT/JP2018/013674, filed on Mar. 30, 2018, which claims the benefits of Japanese Application No. 2017-089451, filed on Apr. 28, 2017, the entire contents of which are hereby incorporated by reference.

TECHNICAL FIELD

The present invention relates to a driver including an injection unit feeding a fastener and a striking unit striking the fastener of the injection unit.

BACKGROUND ART

Conventionally, a driver including an injection unit feeding a fastener and a striking unit striking the fastener of the injection unit is known, and such a driver is described in Patent Document 1. The driver described in the Patent Document 1 includes a striking unit, a first electromagnetic solenoid, a second electromagnetic solenoid, a compression coil spring, a handle, a trigger, a safety actuation piece, a first start switch, a second start switch, a power supply, a magazine, and a feed pawl. The striking unit includes a plunger and a bit. The first electromagnetic solenoid applies a driving force to the plunger. The compression coil spring returns the plunger. The magazine houses a line of the fasteners in which the fasteners are coupled to one another.

In the driver described in the Patent Document 1, when the first start switch is turned on by operation of the trigger while the second start switch is turned on by abutment of the safety actuation piece against a workpiece to be impacted, an exciting current is supplied from the power supply to the first electromagnetic solenoid to suck the striking unit, so that a tip end of the bit strikes and drives a head fastener inside an injection path into the workpiece to be impacted.

When either one or both of the first start switch and the second start switch is turned off, the striking unit is elevated by a force of the compression coil spring, and then, stops. After the striking unit stops, an exciting current is supplied to the second electromagnetic solenoid to actuate the feed pawl, so that the fastener inside the magazine is fed to the injection path.

RELATED ART DOCUMENT

Patent Document

Patent Document 1: Japanese Patent No. 1340055

SUMMARY OF THE INVENTION

Problems to be Solved by the Invention

However, the driver described in the Patent Document 1 has room for improvement in a timing of feeding of the fastener to the injection unit.

An object of the present invention is to provide a driver capable of improving the timing of feeding of the fastener to the injection unit.

Means for Solving the Problems

A driver of one embodiment is a driver including: an injection unit to which a fastener is fed; and a striking unit configured to be capable of stopping and moving between a first position and a second position and to strike the fastener of the injection unit when moving from the first position to the second position, and further includes: an operational member capable of being operated by an operator; a moving mechanism configured to stop and move the striking unit when the operational member is operated; a feeder capable of moving and stopping and configured to feed the fastener to the injection unit by the movement; and a power mechanism configured to stop the feeder during a period of stop of the striking unit but move the feeder to feed the fastener to the injection unit during a period from start of the movement of the striking unit when the operational member is operated to a moment before the striking of the fastener.

A driver of another embodiment is a driver including: an injection unit to which a fastener is fed; and a striking unit configured to be capable of reciprocating between a first position and a second position and to strike the fastener of the injection unit when moving from the first position to the second position, and further includes: an operational member capable of being operated by an operator; a moving mechanism configured to move the striking unit when the operational member is operated; and a power mechanism configured to feed the fastener to the injection unit when the striking unit that is moved by the operation of the operational member is placed at any position in a range from the first position to a striking position at which the fastener can be struck.

Effects of the Invention

In the driver of one embodiment, a timing of feeding of the fastener to the injection unit can be improved.

BRIEF DESCRIPTIONS OF THE DRAWINGS

BEST MODE FOR CARRYING OUT THE INVENTION

One embodiment of a driver of the present invention will be described with reference to the drawings.

First Practical Example

Figure 1:
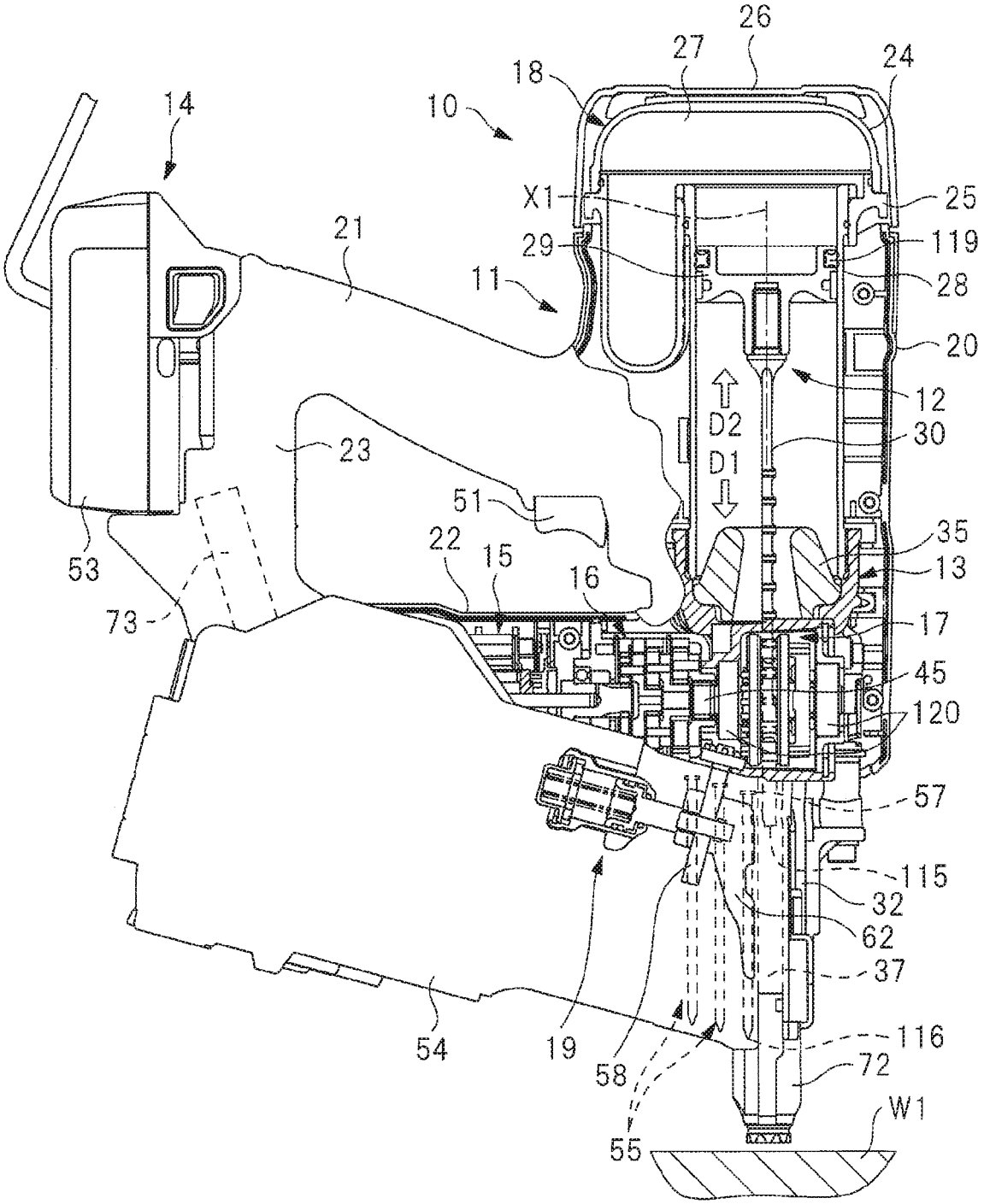
FIG. 1 is a front cross-sectional view showing a first practical example of a driver of one embodiment of the present invention.
Figure 2:
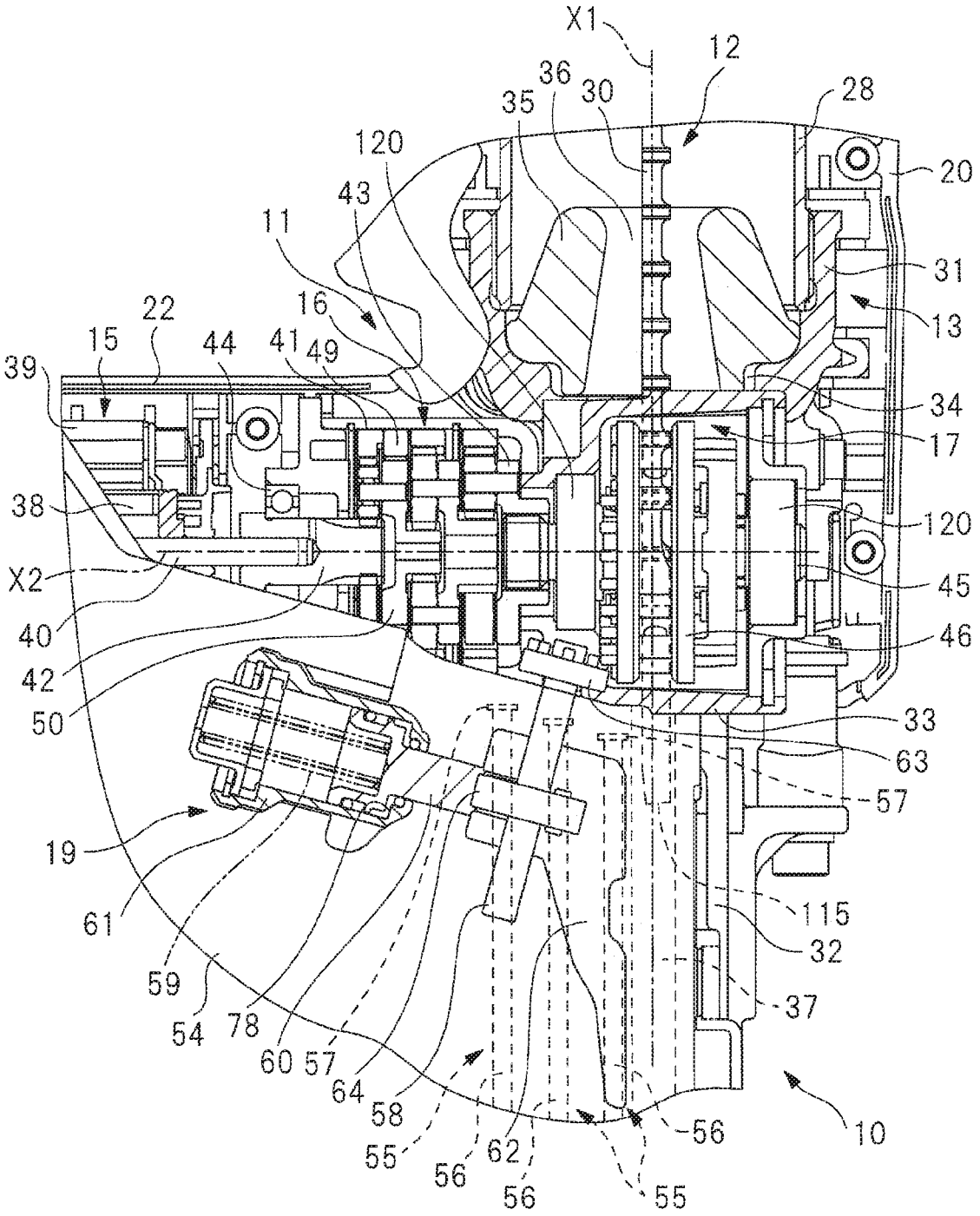
FIG. 2 is a front cross-sectional view showing a part of the first practical example of the driver.

A driver 10 shown in FIGS. 1 and 2 includes a housing 11, a striking unit 12, a nose unit 13, a power supply unit 14, an electric motor 15, a speed reduction mechanism 16, a conversion mechanism 17, an accumulator container 18, and a power mechanism 19. The housing 11 is an outer envelope component of the driver 10, and the housing 11 includes a cylinder case 20, a handle 21 connected to the cylinder case 20, a motor case 22 connected to the cylinder case 20, and an attachment unit 23 connected to the handle 21 and the motor case 22.

The power supply unit 14 is attachable to and detachable from the attachment unit 23. The electric motor 15 is arranged inside the motor case 22. The accumulator container 18 includes a cap 24 and a holder 25 to which the cap 24 is attached. A head cover 26 is attached to the cylinder case 20, and the accumulator container 18 is arranged from inside of the cylinder case 20 to inside of the head cover 26. A pressure chamber 27 is provided inside the accumulator container 18. The pressure chamber 27 is filled with gas. The gas is only necessary to be a compressed gas. As the gas, not only air but also inert gas such as nitrogen gas and rare gas is applicable. The present embodiment will be described in an example in which the pressure chamber 27 is filled with air.

A cylinder 28 is housed inside the cylinder case 20. The cylinder 28 is made of a metal. The cylinder 28 is positioned in a direction of a first center line X1 and a radial direction with reference to the cylinder case 20. The striking unit 12 is arranged from inside of the housing 11 to outside thereof. The striking unit 12 includes a piston 29 and a driver blade 30. The piston 29 is movable inside the cylinder 28 in the direction of the first center line X1 of the cylinder 28. A sealing member 119 is attached to an outer circumferential surface of the piston 29. The sealing member 119 is in contact with an inner circumferential surface of the cylinder 28 to from a sealing surface.

The driver blade 30 is made of a metal. The piston 29 and the driver blade 30 are made of different members from each other, and the piston 29 and the driver blade 30 are connected to each other. The striking unit 12 is movable in the direction of the first center line X1.

The nose unit 13 is arranged in a portion from inside of the cylinder case 20 to outside therefore. The nose unit 13 is positioned in the direction of the first center line X1 with reference to the cylinder case 20, and is positioned in the radial direction of the cylinder 28. The nose unit 13 includes a bumper supporting unit 31, an injection unit 32 and a tubular unit 33. The bumper supporting unit 31 has a tubular shape, and includes a guide hole 34. The guide hole 34 is arranged so as to center the first center line X1.

A bumper 35 is arranged inside the bumper supporting unit 31. The bumper 35 includes a guide hole 36. The bumper 35 is monolithically molded with a synthetic rubber such as elastomer. The guide hole 36 is formed so as to center the first center line X1. The driver blade 30 is movable inside the guide hole 36 in the direction of the first center line X1.

The injection unit 32 is connected to the bumper supporting unit 31 and the tubular unit 33, and protrudes from the bumper supporting unit 31 in the direction of the first center line X1. The injection unit 32 includes an injection path 37, and the injection path 37 is concentrically provided with the first center line X1. The driver blade 30 is movable inside the injection path 37 in the direction of the first center line X1.

The electric motor 15 is arranged inside the motor case 22. The electric motor 15 includes a rotor 38 and a stator 39. The stator 39 is fixed to the motor case 22. The rotor 38 is attached to a rotational shaft 40.

A gear case 41 is provided inside the motor case 22. The gear case 41 has a tubular shape, and the gear case 41 does not rotate with respect to the tubular unit 33. The speed reduction mechanism 16 is provided inside the gear case 41. The speed reduction mechanism 16 includes an input component 42, an output component 43 and a plurality of sets of planetary gear mechanisms. The input component 42 of the speed reduction mechanism 16 is coupled to the rotational shaft 40, and the input component 42 is rotatably supported by a bearing 44.

Figure 3:
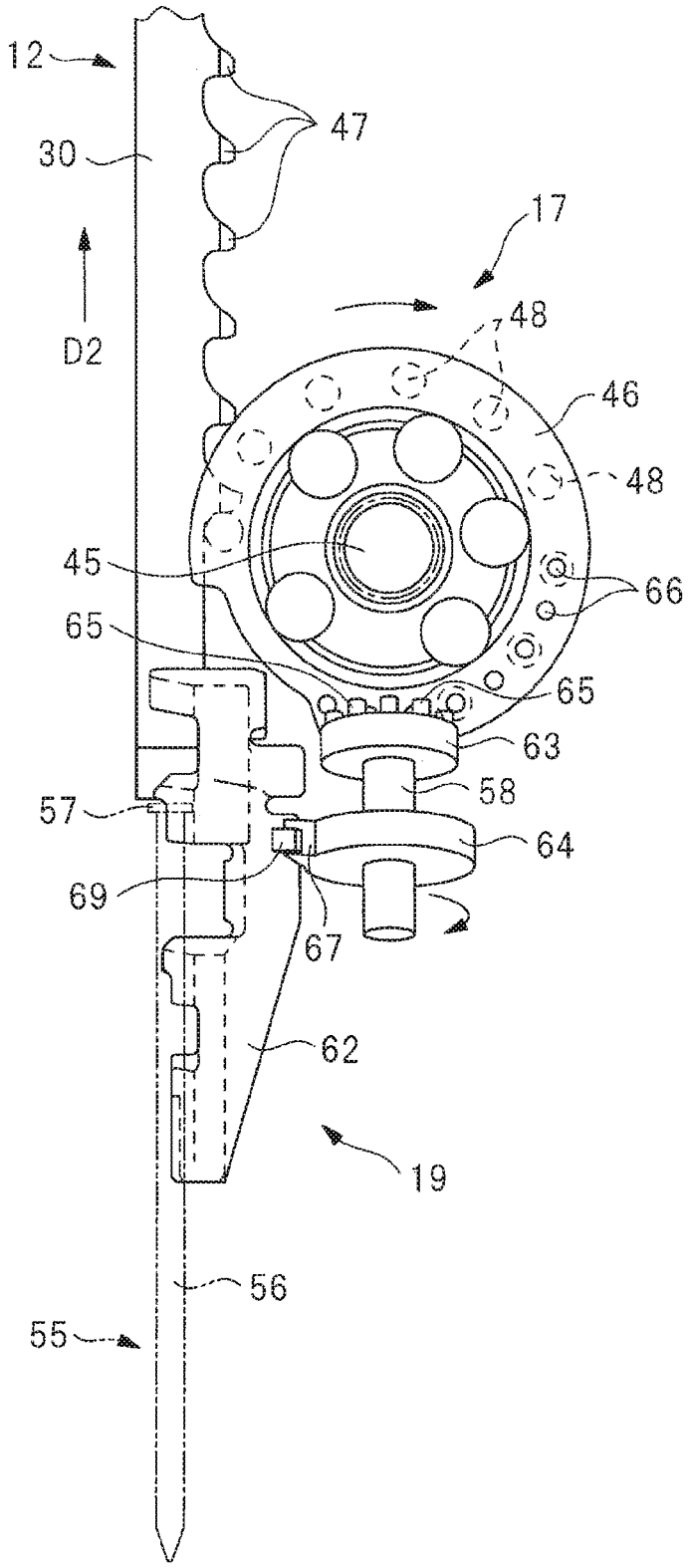
FIG. 3 is a left side view showing motion of a power mechanism provided in the driver.

The conversion mechanism 17 is arranged inside the tubular unit 33. The conversion mechanism 17 converts torque of the output component 43 into moving force of the striking unit 12. The conversion mechanism 17 includes a driving shaft 45, a pin wheel 46 and a convex unit 47 as shown in FIG. 3. As shown in FIG. 2, there are two bearings 120 supporting the driving shaft 45 so as to be rotatable around a second center line X2 as center. The pin wheel 46 is fixed to the driving shaft 45, and the pin wheel 46 includes a plurality of pinion pins 48. The plurality of pinion pins 48 are arranged so as to have a gap therebetween in a rotational direction of the pin wheel 46 as shown in FIG. 3. The plurality of pinion pins 48 are arranged in a range of a predetermined angle in the rotational direction of the pin wheel 46.

A plurality of the convex units 47 are arranged so as to have a gap therebetween in the moving direction of the driver blade 30. The plurality of pinion pins 48 can independently engage with and release from the plurality of the convex units 47, respectively. When the pin wheel 46 rotates clockwise in FIG. 3 to engage at least one pinion pin 48 with at least one convex unit 47, the torque of the pin wheel 46 is transmitted to the striking unit 12. Then, the striking unit 12 moves in a second direction D2 against a pressure of the pressure chamber 27. When all the pinion pins 48 release from the convex unit 47, the torque of the pin wheel 46 is not transmitted to the striking unit 12.

The striking unit 12 is always urged in a first direction D1 by the pressure of the pressure chamber 27. The movement of the striking unit 12 in the first direction D1 in FIG. 1 is referred to as dropping. The movement of the striking unit 12 in the second direction D2 in FIG. 1 is referred to as elevation. The first direction D1 and the second direction D2 are parallel to the first center line X1, and the second direction D2 is opposite to the first direction D1.

As shown in FIG. 2, a rotation regulating mechanism 49 is provided inside the gear case 41. The rotation regulating mechanism 49 is arranged between a component configuring the planetary gear such as a carrier 50 and a ring fixed to the gear case 41. The rotation regulating mechanism 49 includes, for example, a roller and a ball. When the striking unit 12 is urged in the first direction D1 in a state in which the pinion pin 48 and the convex unit 47 engage with each other so that a counterclockwise torque in FIG. 3 is applied to the pinwheel 46, the rotation regulating mechanism 49 is wedged between the carrier 50 and the ring to prevent the rotation of the pin wheel 46 by using wedge effect. On the other hand, when the torque of the electric motor 15 is transmitted to the speed reduction mechanism 16, the rotation regulating mechanism 49 is not wedged between the carrier 50 and the ring. That is, the rotation regulating mechanism 49 allows the pinwheel 46 to rotate clockwise in FIG. 3.

Figure 4:
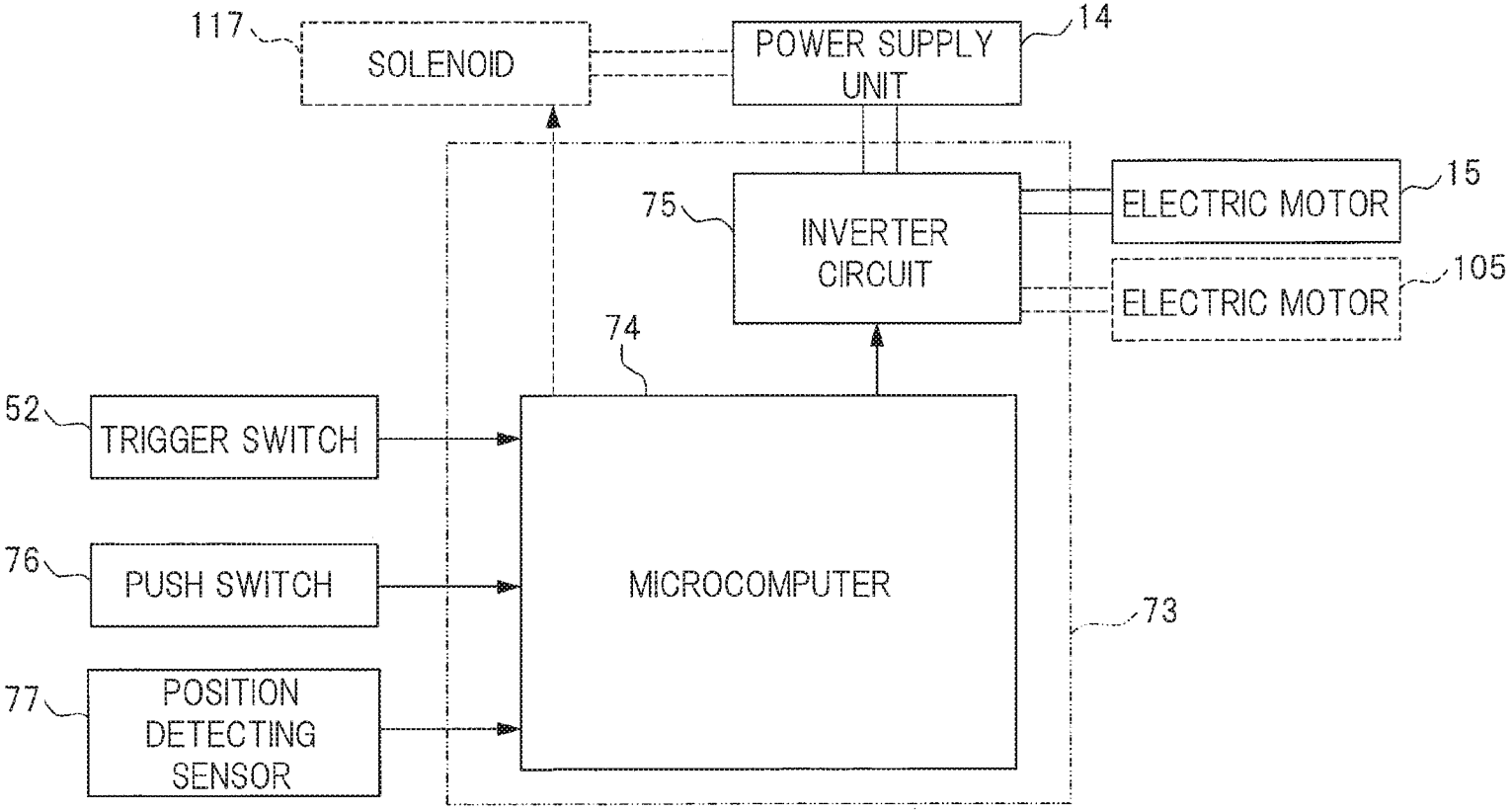
FIG. 4 is a block diagram showing a control system in the driver.

As shown in FIG. 1, a trigger 51 is provided at the handle 21. An operator such as a user operates the trigger 51 while holding the handle 21. A trigger switch 52 shown in FIG. 4 is provided inside the handle 21. The trigger switch 52 turns on when an operational force is applied to the trigger 51, and turns off when the operational force applied to the trigger 51 is released.

The power supply unit 14 can supply power to the electric motor 15. The power supply unit 14 includes a housing case 53 and a plurality of battery cells housed inside the housing case 53. The battery cell is a secondary battery that can be charged and discharged. As the battery cell, any of a lithium ion battery, a nickel hydride battery, a lithium ion polymer battery and a nickel cadmium battery can be used.

The magazine 54 shown in FIG. 1 is provided, and the magazine 54 is supported by the injection unit 32 and the attachment unit 23. The magazine 54 houses nails (fasteners) 55. As shown in FIG. 2, the nail 55 includes a shank portion 56 and a head portion 57. The nails 55 housed inside the magazine 54 are coupled with each other by a coupling component such as an adhesive material or a wire. That is, the plurality of nails 55 are housed inside the magazine 54 so that the nails are parallel to each other. The plurality of nails 55 are housed inside the magazine 54 so as to be rolled.

Figure 5:
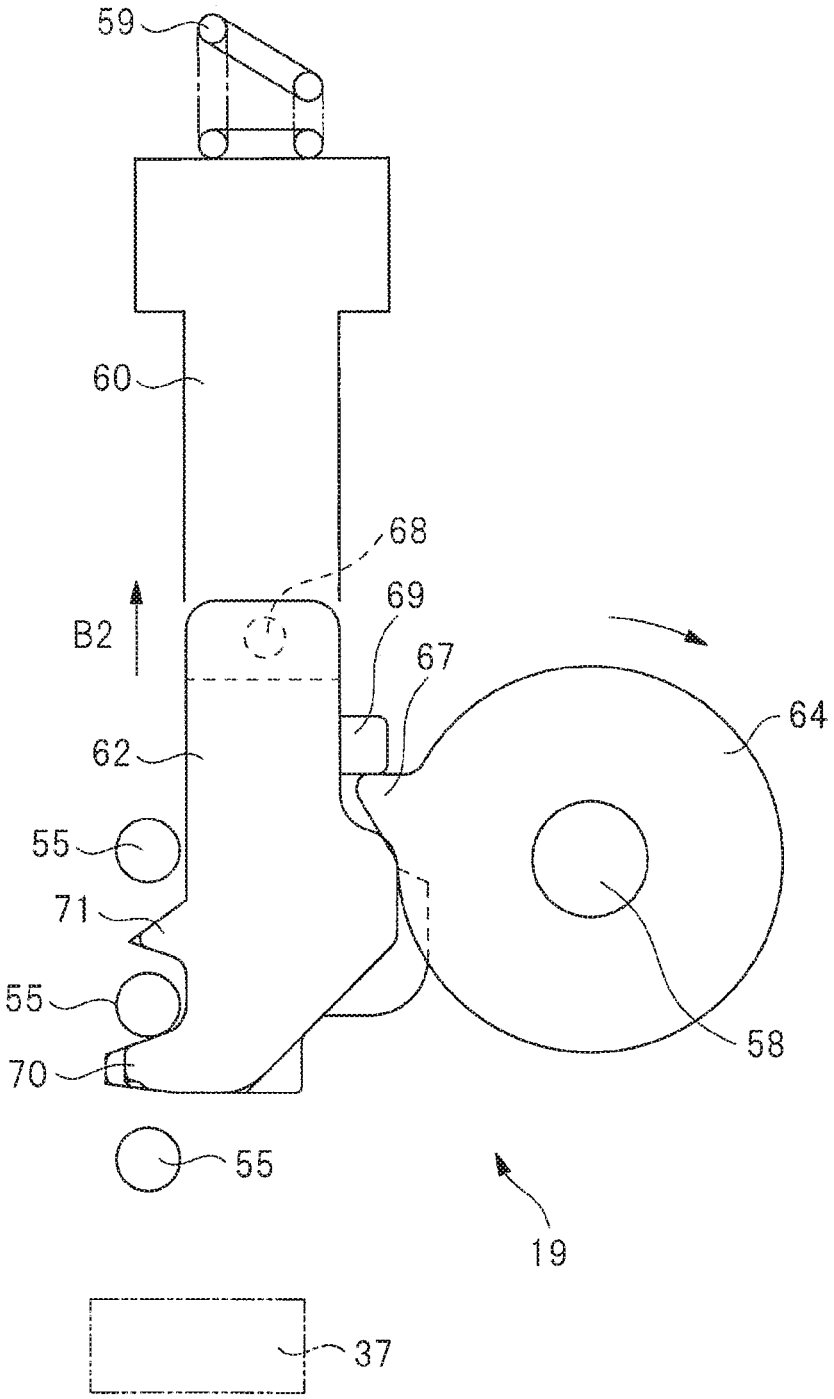
FIG. 5 is a bottom view showing motion of the power mechanism provided in the driver.

The power mechanism 19 feeds the nail 55 from the inside of the magazine 54 to the injection unit 32. The power mechanism 19 includes the electric motor 15, the pin wheel 46, the rotational shaft 58, a spring 59, a piston 60, a cylinder 61 and a feeder 62. The rotational shaft 58 is rotatably supported by the magazine 54, and the rotational shaft 58 includes a flange 63 and a cam 64. The flange 63 includes a plurality of pins 65. The plurality of pins 65 are arranged in a rotational direction of the rotational shaft 58. The pint wheel 46 includes a plurality of pins 66. The plurality of pins 66 are arranged in a rotational direction of the pin wheel 46. By the rotation of the pin wheel 46, the pin 66 and the pin 65 can be engaged with and released from each other. By the engagement of at least one pin 66 with at least one pin 65, the torque of the pin wheel 46 is transmitted to the rotational shaft 58. The cam 64 has a disk shape, and is provided with an engagement unit 67 that protrudes from an outer circumferential surface of the cam 64 as shown in FIG. 5.

The cylinder 61 is fixed to the magazine 54. The piston 60 can reciprocate along the cylinder 61. That is, the piston 60 can come close to and go away from the injection path 37. The spring 59 urges the piston 60 in a direction coming close to the injection path 37. The piston 60 is urged by the spring 59 to be in contact with an end surface 78 of the cylinder 61. The feeder 62 can reciprocate together with the piston 60, and the feeder 62 is ratotably attached to the piston 60 through the support shaft 68. An urging member that urges the feeder 62 clockwise around the support shaft 68 is provided. The urging member includes a spring. The feeder 62 includes an engagement unit 69 and feed pawls 70 and 71. The feed pawls 70 and 71 are arranged so as to put a gap therebetween in a direction of the movement of the feeder 62 together with the piston 60.

As shown in FIG. 1, a push lever 72 is attached to the injection unit 32. The push lever 72 is movable from the injection unit 32 in a predetermined range in the direction of the first center line X1. The control unit 73 is provided inside the attachment unit 23. The control unit 73 includes a substrate, and a microcomputer 74 and an inverter circuit 75 shown in FIG. 4. The microcomputer 74 includes an input/output interface, a computing processor unit and a memory unit. The inverter circuit 75 connects and disconnects an electric circuit between the power supply unit 14 and the electric motor 15. The inverter circuit 75 includes a plurality of switching elements, and the plurality of switching elements can independently turn on and off. The microcomputer 74 controls the inverter circuit 75.

A push switch 76 shown in FIG. 4 is provided at the injection unit 32. The push switch 76 turns on when the push lever 72 is pressed against the workpiece W1 to be impacted, and turns off when the push lever 72 goes away from the workpiece W1 to be impacted. A position detecting sensor 77 shown in FIG. 4 is provided inside the housing 11. The position detecting sensor 77 detects a position of the striking unit 12 in the direction of the first center line X1, and outputs the signal. In an example of FIG. 2, a phase detecting sensor that detects a phase of the pin wheel 46 in the rotation direction is provided, and the phase detecting sensor plays a role of the position detecting sensor 77. A signal of the trigger switch 52, a signal of the push switch 76 and a signal of the position detecting sensor 77 are input to the microcomputer 74. The microcomputer 74 processes the signal of the trigger switch 52, the signal of the push switch 76 and the signal of the position detecting sensor 77 to control the inverter circuit 75.

An example of the usage of the driver 10 by the user will be described as follows. The control unit 73 stops the electric motor 15 when detecting at least either one of the turning off of the trigger switch 52 and the turning off of the push switch 76. Meanwhile, the striking unit 12 is always urged in the first direction D1 by the pressure of the pressure chamber 27. The pinion pin 48 and the convex unit 47 engage with each other, and an urging force applied to the striking unit 12 is transmitted to the pin wheel 46, and therefore, a counterclockwise torque in FIG. 3 is applied to the pin wheel 46. The rotation regulating mechanism 49 prevents the pin wheel 46 from rotating so that the striking unit 12 stops at an idle position shown in FIG. 3. When the striking unit 12 stops at the idle position, the striking unit 12 stops between a top dead point and a bottom dead point as shown in FIG. 1.

The top dead point of the striking unit 12 is a position at which the piston 29 is the farthest from the bumper 35 in the direction of the first center line X1. The bottom dead point of the striking unit 12 is a position at which the piston 29 is in contact with the bumper 35.

When the striking unit 12 stops at the idle position, a tip end 115 of the driver blade 30 is positioned between a tip end of the nail 55 and the head portion 57 of the nail 55 that is positioned at the closest to the injection path 37 as shown in FIG. 1. As shown in FIG. 5, the engagement unit 67 engages with the engagement unit 69, so that the feeder 62 stops. The feed pawl 71 is positioned between a first nail 55 and a second nail 55 in a direction feeding the nails 55. When the striking unit 23 stops at the idle position, the nail 55 is not positioned at the injection path 37.

The control unit 73 supplies the power of the power supply unit 14 to the electric motor 15 when detecting the turning on of the trigger switch 52 and the turning on of the push switch 76. The torque of the electric motor 15 is transmitted to the pin wheel 46 through the speed reduction mechanism 16. The pin wheel 46 rotates clockwise in FIG. 3.

By the rotation of the pin wheel 46, the striking unit 12 is elevated in the second direction D2, and the pressure of the pressure chamber 27 is increased. The torque of the pin wheel 46 is transmitted to the rotational shaft 58, so that the rotational shaft 58 rotates clockwise in FIG. 5. Therefore, the feeder 62 moves against the urging force of the spring 59 in a second direction B2 going away from the injection path 37.

Figure 6:
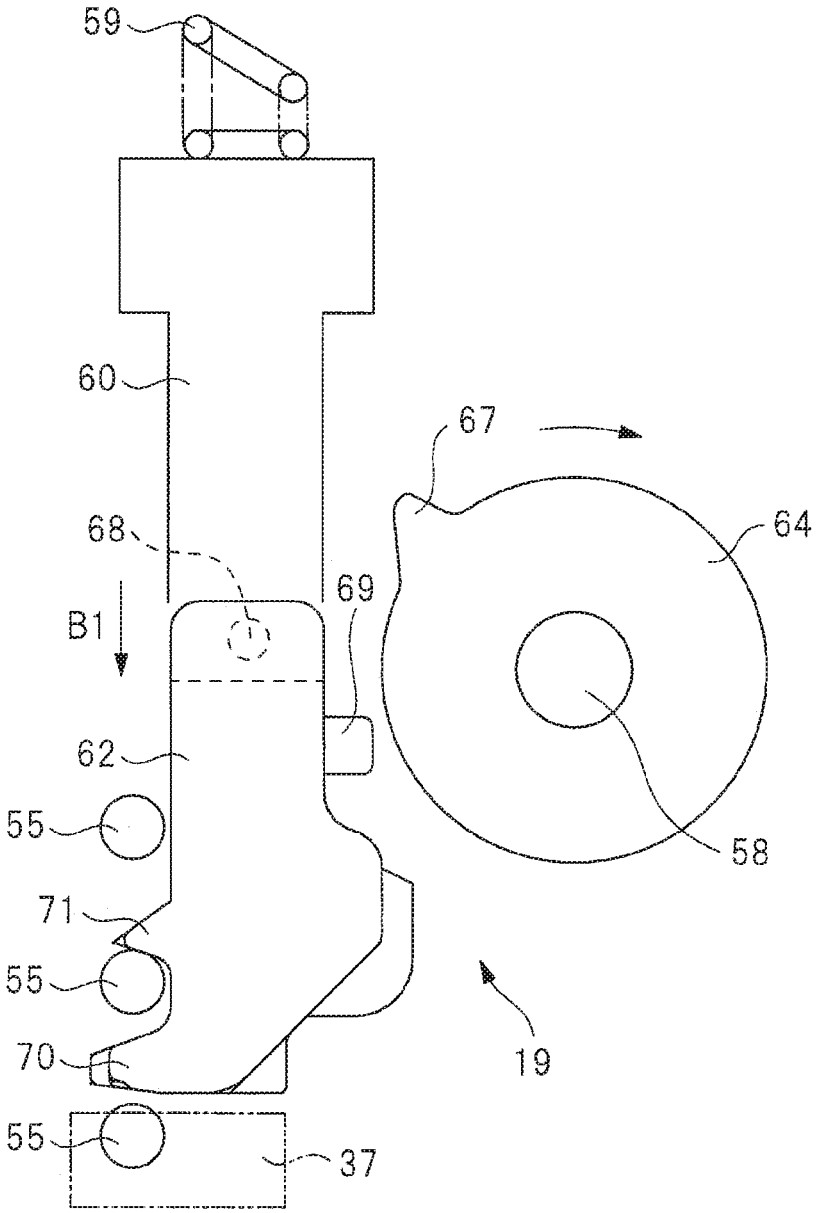
FIG. 6 is a bottom view showing motion of the power mechanism provided in the driver.

Then, when the engagement unit 67 is released from the engagement unit 69 as shown in FIG. 6 by the rotation of the rotational shaft 58, the feeder 62 moves in a first direction B1, so that a nail 55 that is at the first position in the direction feeding the nails 55 is fed to the injection path 37. Further, the piston shown in FIG. 2 is in contact with the end surface 78, so that the feeder 62 stops.

Figure 7:
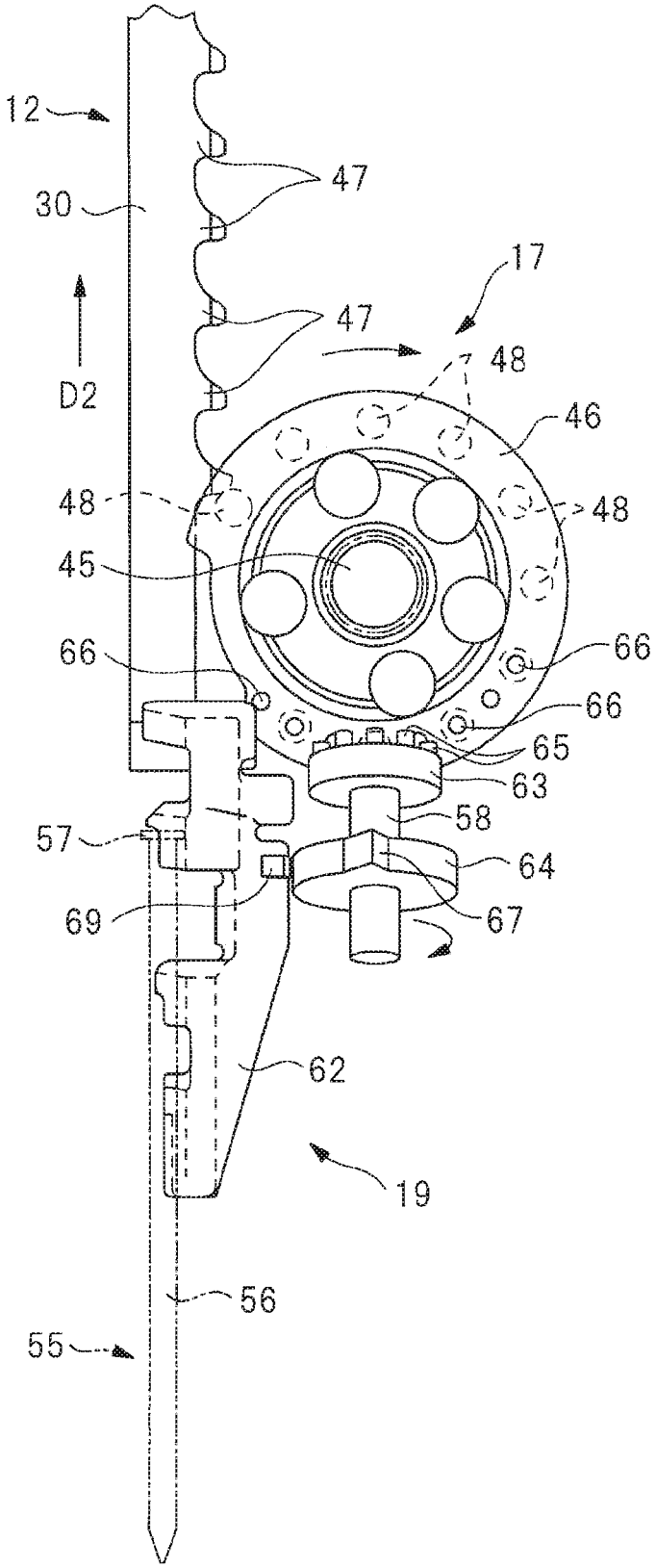
FIG. 7 is a left side view showing motion of the power mechanism provided in the driver.

Further, the pin wheel 46 rotates, so that the striking unit 12 arrives at the top dead point as shown in FIG. 7. The rotational shaft 58 keeps the clockwise rotation. Then, when all the pinion pins 48 are released from the convex units 47, the striking unit 12 is dropped by the pressure of the pressure chamber 27. During a period of the dropping of the striking unit 12, the pin 66 and the pin 65 engage with each other, and the rotational shaft 58 keeps the rotation. When the striking unit 12 drops, the driver blade 30 strikes the nail 55 of the injection path 37, so that the nail 55 is driven into the workpiece W1 to be impacted.

Figure 8:
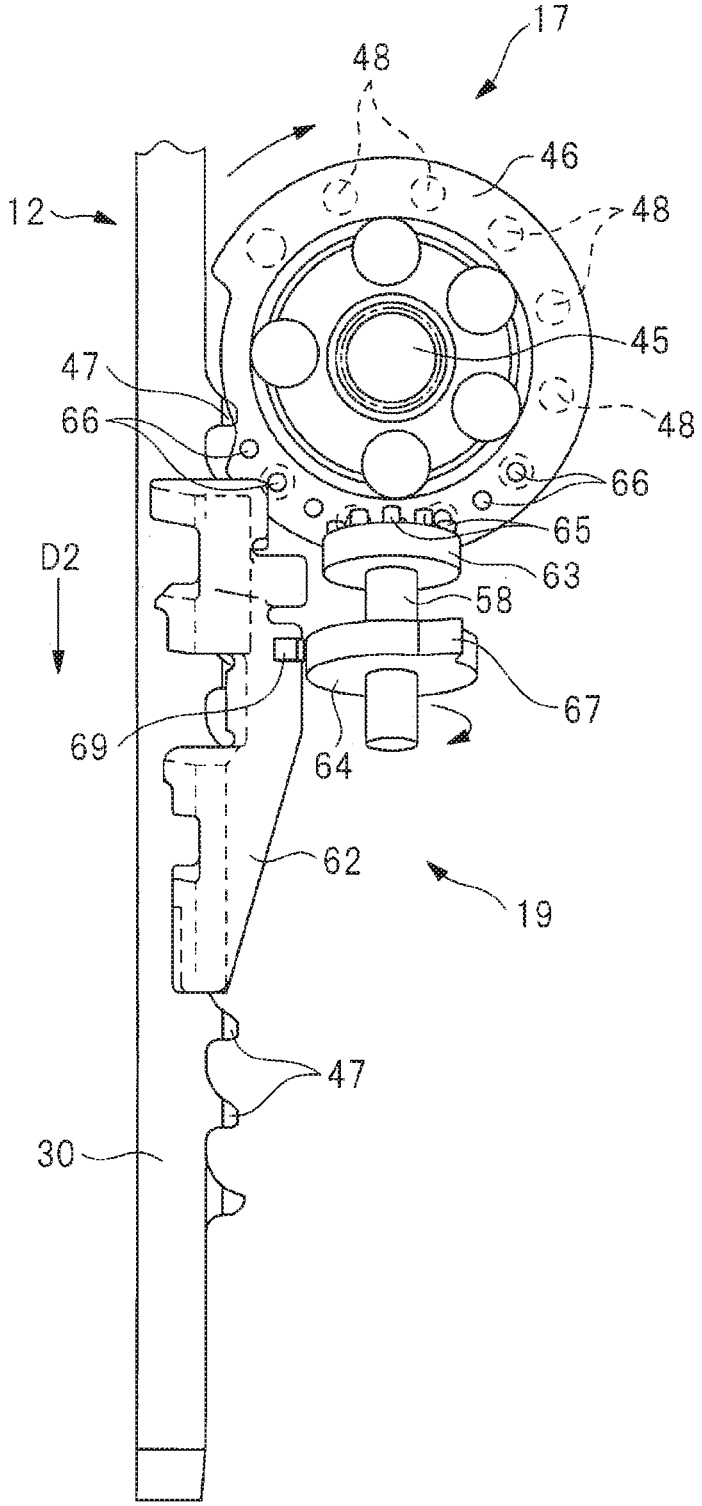
FIG. 8 is a left side view showing motion of the power mechanism provided in the driver.

After the driver blade 30 strikes the nail 55, the piston 29 collides with the bumper 35. The bumper 35 absorbs kinetic energy of the striking unit 12. That is, the striking unit 12 arrives at the bottom dead point as shown in FIG. 8, and then, stops. The control unit 73 rotates the electric motor 15 even after the striking unit 12 arrives at the bottom dead point, so that the rotational shaft 58 keeps the rotation. However, since the engagement unit 67 releases from the engagement unit 69, the feeder 62 stops.

Figure 9:
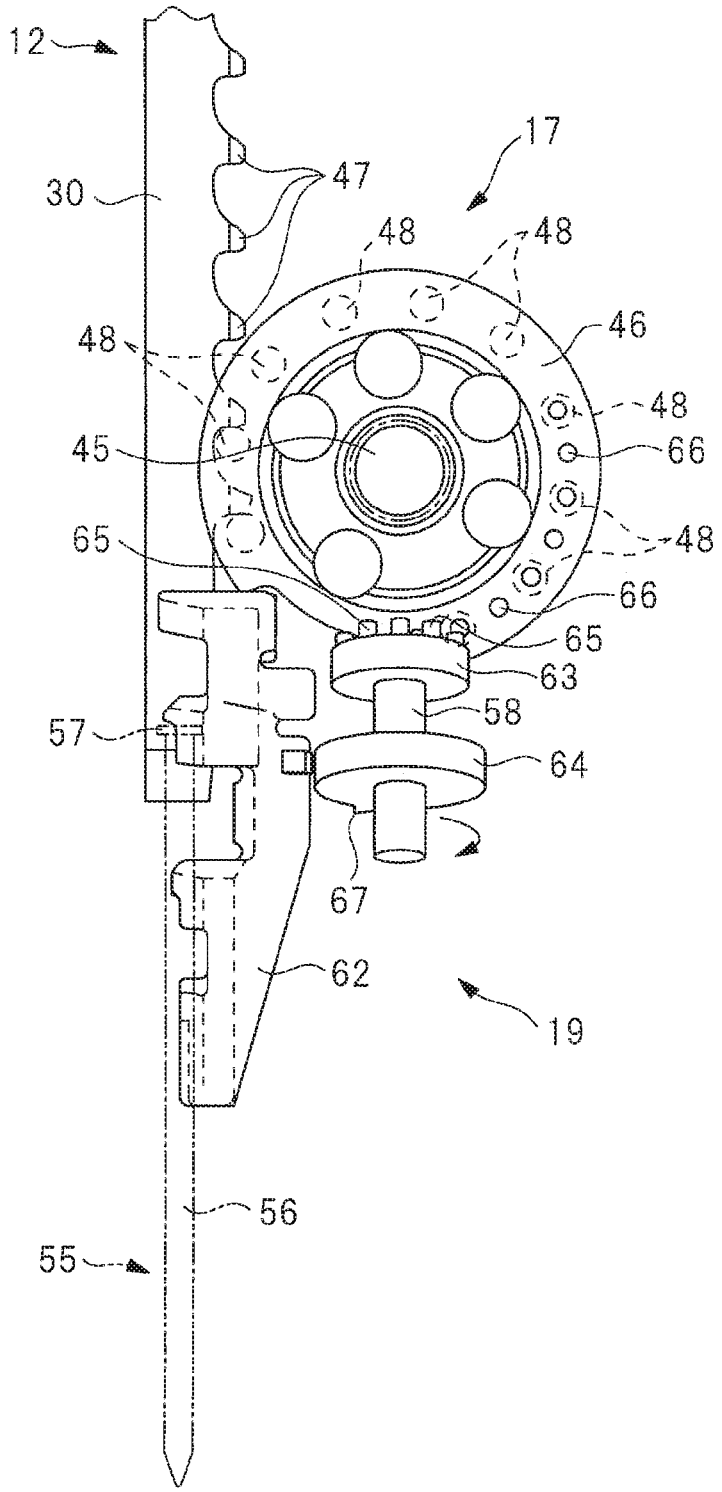
FIG. 9 is a left side view showing motion of the power mechanism provided in the driver.

When the rotation of the pin wheel 46 is kept so that the pinion pins 48 engage with the convex units 47, the striking unit 12 elevates from the bottom dead point toward the top dead point as shown in FIG. 9. While the rotational shaft 58 is rotating, the engagement unit 67 releases from the engagement unit 69, and therefore, the feeder 62 stops.

Figure 10:
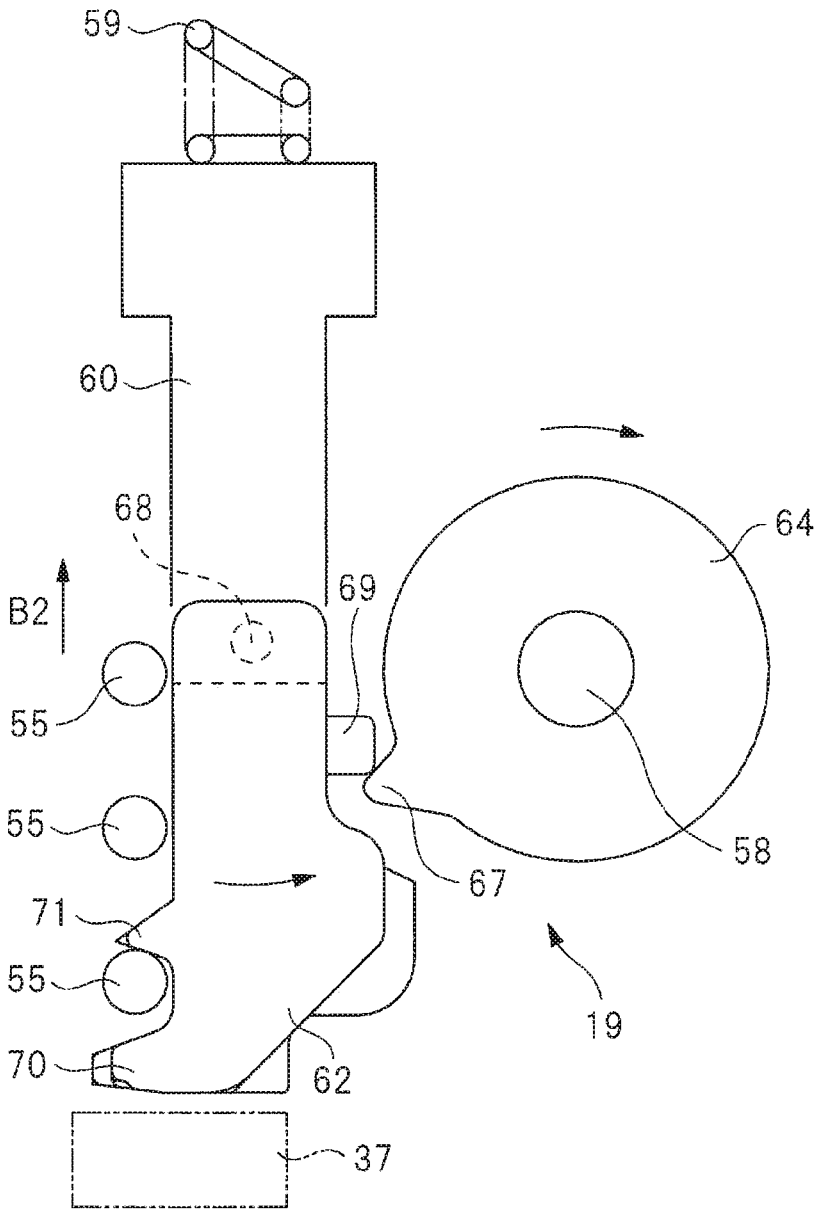
FIG. 10 is a bottom view showing motion of the power mechanism provided in the driver.

When the striking unit 12 is further elevated in the second direction D2 by the rotation of the pin wheel 46, the engagement unit 67 engages with the engagement unit 69 as shown in FIG. 10. Next, when the feed pawls 70 and 71 are brought into contact with the nail 55 by the rotation of the rotational shaft 58, the feeder 62 rotates counterclockwise around the support shaft 68 in FIG. 10 due to a reactive force of the contact. When the feed pawls 70 and 71 rides over the nail 55, the feeder 62 rotates clockwise around the support shaft 68, so that the feed pawls 70 and 71 are wedged between the nails 55. The control unit 73 stops the electric motor 15 when detecting the arrival of the striking unit 12 at the idle position as shown in FIG. 3. The control unit 73 processes a signal of the position detecting sensor 77 to detect whether the striking unit 12 has arrived at the idle position.

In the driver 10 of the first practical example, a relation between the position of the striking unit 12 in the direction of the first center line X1 and the timing of the feeding of the nail 55 to the injection path 37 can be designed. Specifically, the relation between the position of the striking unit 12 and the timing of the feeding of the nail 55 can be designed by adjustment of arrangement positions of the plurality of pinion pins 48 and arrangement positions of the plurality of pins 66 in the rotational direction of the pin wheel 46. For example, when a plurality of female threaded bores are provided in the rotational direction of the pin wheel 46 while a male thread is formed in the pin 66, the relation between the position of the striking unit 12 and the timing of the feeding of the nail 55 can be changed by change of the arrangement positions of the plurality of pins 66 in the rotational direction of the pin wheel 46.

Further, by change of a position at which the engagement unit 67 is provided in the rotational direction of the cam 64, a relation between the position of the striking unit 12 in the direction of the first center line X1 and the timing of the feeding of the nail 55 to the injection path 37 can be also designed.

Therefore, the nail 55 can be fed to the injection path 37 during a period from the dropping of the striking unit 12 after the user's operation of the trigger 51 to the striking of the nail 55 by the driver blade 30. In other words, the nail 55 can be fed to the injection path 37 at any of a moment before the arrival of the striking unit 12 at the top dead point, a moment of the arrival of the striking unit 12 at the top dead point, and a moment during a period from the movement of the striking unit 12 from the top dead point to the arrival thereof at a position that allows the striking unit to strike the nail 55.

When the shape of the outer circumferential surface of the pinion pin 48 engaging with the convex unit 47 is designed to be a shape following the outer circumferential surface of the pin wheel 46 at the moment of the arrival of the striking unit 12 at the top dead point, the striking unit 12 can stop at the top dead point for predetermined time during the rotation of the pin wheel 46. In the driver 10 having such a configuration, the nail 55 can be fed to the injection path 37 during the period of the stoppage of the striking unit 12 at the top dead point.

Second Practical Example

Figure 11:
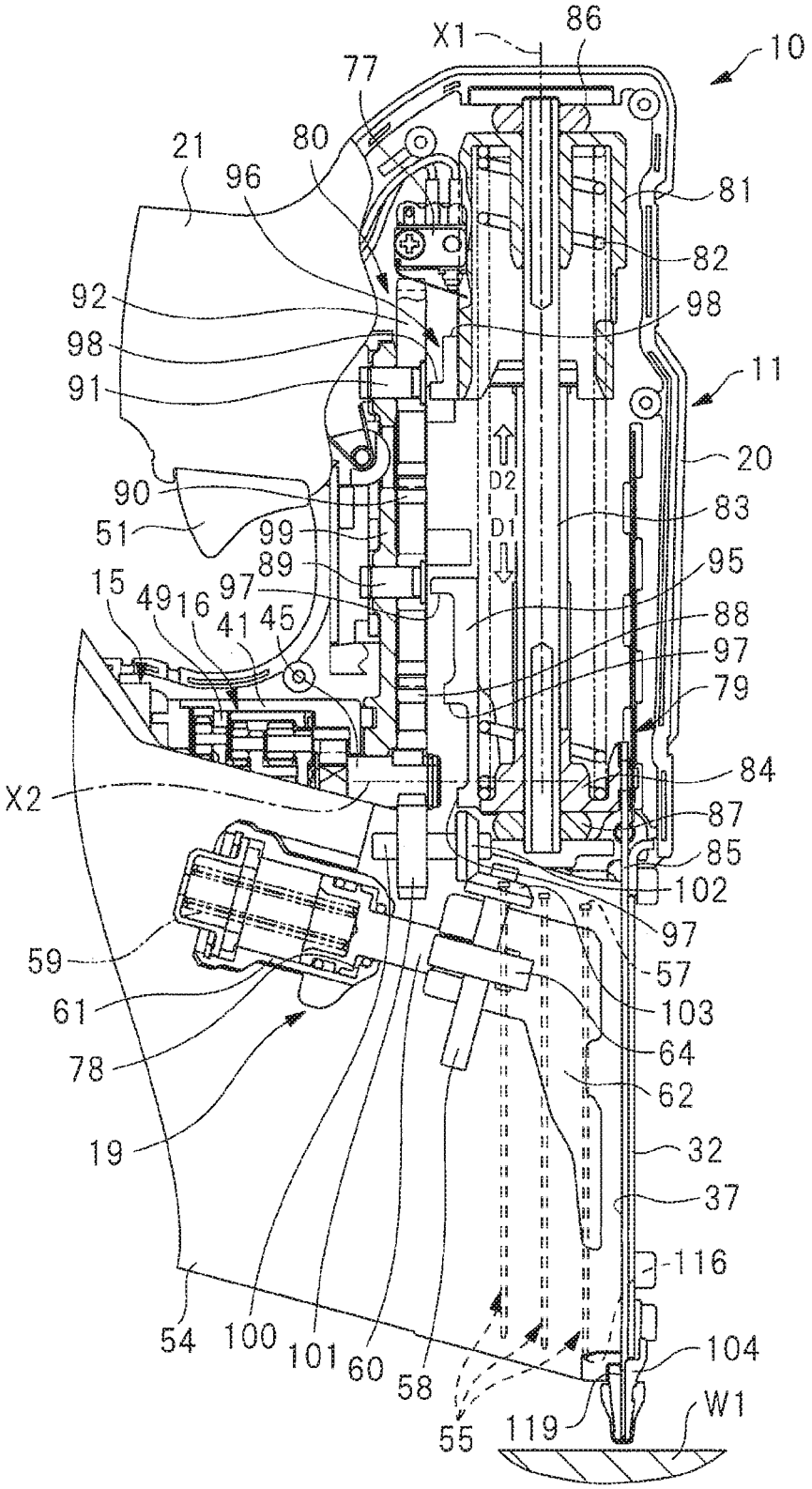
FIG. 11 is a partial cross-sectional view showing a second practical example of the driver.

FIG. 11 shows a driver 10 of a second practical example. In the driver 10 of the second practical example, the same components as those of the driver 10 of the first practical example are denoted with the same reference symbols as those of the driver 10 of the first practical example. The driver 10 of FIG. 11 includes a striking unit 79, a driving mechanism 80, a weight 81, a spring 82 and a plunge shaft 83.

The striking unit 79 includes a metallic plunger 84 arranged inside the housing 11 and a metallic driver blade 85 fixed to the plunger 84. The plunger shaft 83 is provided inside the housing 11, and is fixed to the housing 11. The first center line X1 of the plunger shaft 83 is parallel to the injection path 37. The plunger 84 is attached to the plunger shaft 83, and the striking unit 79 is movable in the direction of the first center line X1. Inside the injection path 37, the driver blade 85 is movable in parallel to the first center line X1.

The weight 81 has a tubular shape, and is attached to the plunger shaft 83. The weight 81 is movable in the direction of the first center line X1 with respect to the plunger shaft 83. The spring 82 is provided inside the housing 11, and the spring 82 is arranged between the plunger 84 and the weight 81 in the direction of the first center line X1. The spring 82 is a compressed coil spring, and is compressible and extendable in the direction of the first center line X1. As a material of the spring 82, metal, non-ferrous metal or ceramic can be used.

Inside the housing 11, the weight bumper 86 and the plunger bumper 87 are provided. The plunger 84 is arranged between the weight 81 and the plunger bumper 87 in the direction of the first center line X1. Both the weight bumper 86 and the plunger bumper 87 are made of synthetic rubber.

To the plunger 84, an urging force in the first direction D1 coming close to the plunger bumper 87 in the direction of the first center line X1 is applied from the spring 82. To the weight 81, an urging force in the second direction D2 coming close to the weight bumper 86 in the direction of the first center line X1 is applied from the spring 82.

In FIG. 11, movement of the striking unit 79, the plunger 84 or the weight 81 in the first direction D1 is referred to as "dropping". In FIG. 11, movement of the striking unit 79, the plunger 84 or the weight 81 in the second direction D2 is referred to as "elevation". Inside the housing 11, the position detecting sensor 77 is provided. The position detecting sensor 77 detects the position of the weight 81 in the direction of the first center line X1, and outputs a signal.

The driving mechanism 80 converts the torque of the driving shaft 45 into a motion force of the striking unit 79, and converts the torque of the driving shaft 45 into a motion force of the weight 81. The driving mechanism 80 includes a first gear 88, a second gear 90 and a third gear 92 shown in FIG. 12. The first gear 88 is fixed to the driving shaft 45, the second gear 90 is rotatably supported by a second shaft 89, and the third gear 92 is rotatably supported by a third shaft 91.

Figure 12:
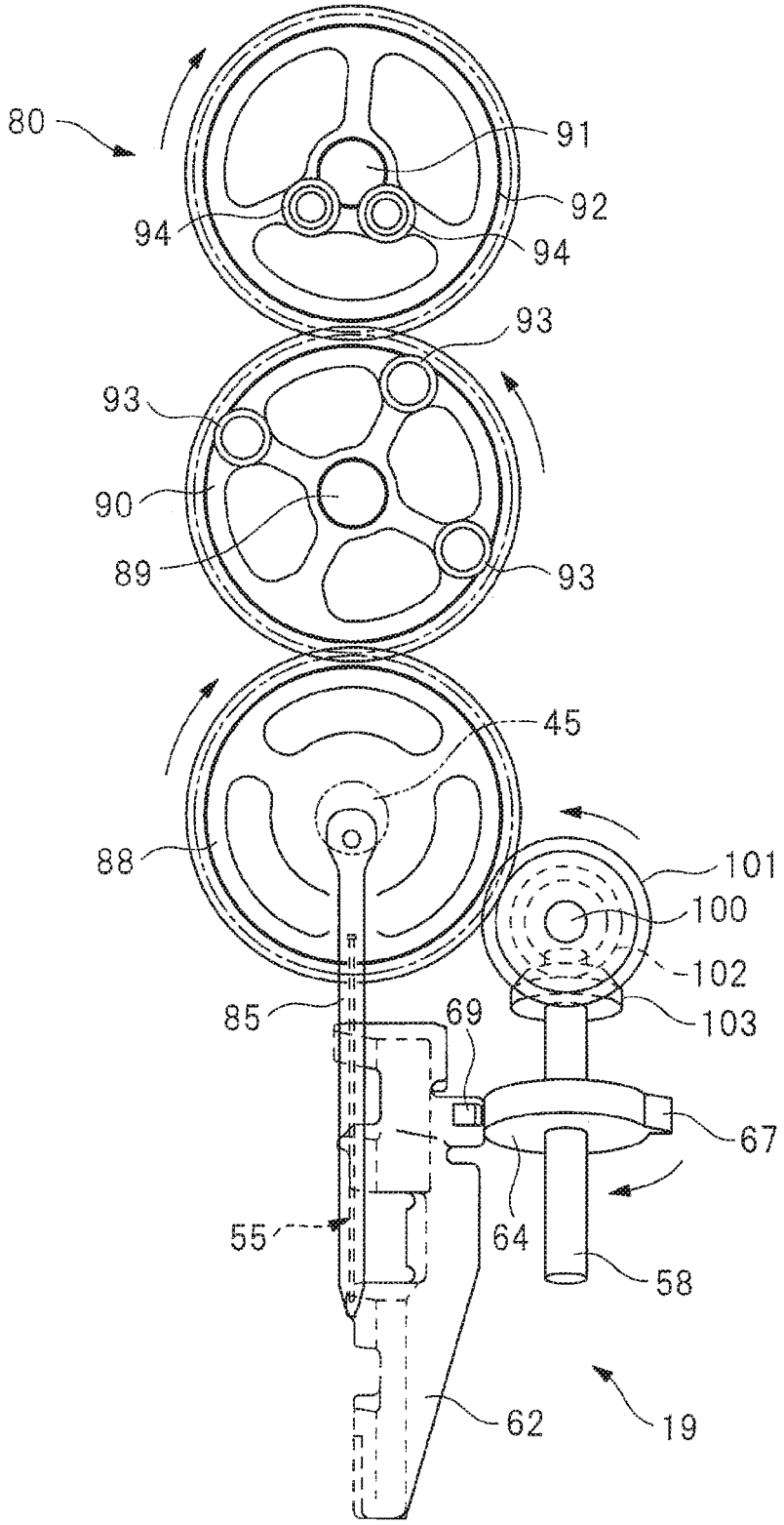
FIG. 12 is a side view of a driving mechanism and a power mechanism provided in FIG. 11.

A plurality of cam rollers 93 are provided at the second gear 90. FIG. 12 shows an example of three cam rollers 93 so that the three cam rollers 93 are arranged so as to have a gap therebetween in a rotational direction of the second gear 90. Each of the three cam rollers 93 is rotatable with respect to the second gear 90. A plurality of cam rollers 94 are provided at the third gear 92. FIG. 12 shows an example of two cam rollers 94 so that the two cam rollers 94 are arranged so as to have a gap therebetween in a rotational direction of the third gear 92. Each of the two cam rollers 94 is rotatable with respect to the third gear 92.

A plunger arm unit 95 is provided at the plunger 84, and a weight arm unit 96 is provided at the weight 81. The plunger arm unit 95 includes a plurality of engagement units 97, and the weight arm unit 96 includes a plurality of engagement units 98. The number of the engagement units 97 is the same as the number of the cam rollers 93, and the number of the engagement units 98 is the same as the number of the cam rollers 94. Each of the driving shaft 45, the second shaft 89 and the third shaft 91 is supported by a gear holder 99.

The second gear 90 is arranged between the first gear 88 and the third gear 92 in the direction of the first center line X1, and the second gear 90 meshes with the first gear 88 and the third gear 92. All the first gear 88, the second gear 90 and the third gear 92 are the same as one another in the number of mesh teeth and the outer diameter.

When the torque of the electric motor 15 is transmitted to the driving shaft 45, the first gear 88 rotates clockwise, the second gear 90 rotates counterclockwise, and the third gear 92 rotates clockwise in FIG. 12.

The power mechanism 19 includes a rotational shaft 100, and a gear 101 and a bevel gear 102 are attached to the rotational shaft 100. The rotational shaft 100 is arranged in parallel to the driving shaft 45, and the gear 101 meshes with the first gear 88. A bevel gear 103 is attached to the rotational shaft 58, and the bevel gear 103 and the bevel gear 102 mesh with each other. Note that a pressing member 104 is provided at the injection unit 32 so that the pressing member 104 does not move with respect to the injection unit 32 in the direction of the first center line X1.

Next, an example of usage of the driver 10 by the user will be described. When the trigger switch 52 is turned off to stop the electric motor 15, the striking unit 79 and the weight 81 stop at the idle position. When the striking unit 79 and the weight 81 stop at the idle position, the cam roller 93 engages with the engagement unit 97, and the cam roller 94 engages with the engagement unit 98. The control unit 73 estimates the positions of the striking unit 79 and the weight 81 in the direction of the first center line X1 by processing the signal of the position detecting sensor 77. When the striking unit 79 and the weight 81 are at the idle position, the control unit 73 stops the electric motor 15. When the striking unit 79 stops at the idle position, the plunger 84 is away from the plunger bumper 87. When the weight 81 stops at the idle position, the weight 81 is away from the weight bumper 86.

An urging force in the first direction D1 is applied from the spring 82 to the striking unit 79, and an urging force in the second direction D2 is applied from the spring 82 to the weight 81. The urging force in the first direction D1 applied to the striking unit 79 is transmitted to the second gear 90 through the plunger arm unit 95 and the cam roller 93, so that a clockwise torque shown in FIG. 12 is applied to the second gear 90.

The urging force in the second direction D2 applied to the weight 81 is transmitted to the third gear 92 through the weight arm unit 96 and the cam roller 94, so that a counterclockwise torque shown in FIG. 12 is applied to the third gear 92. The counterclockwise torque applied to the third gear 92 becomes a torque in a direction rotating the second gear 90 clockwise.

When the clockwise torque is applied to the second gear 90 as described above, the torque is transmitted to the first gear 88, so that a counterclockwise torque shown in FIG. 12 is applied to the first gear 88. The rotation regulating mechanism 49 prevents the driving shaft 45 from rotating counterclockwise in FIG. 12. Therefore, the first gear 88 is maintained in the stop state. In the manner, the striking unit 79 and the weight 81 are kept at the idle position.

When the user presses the pressing member 104 against the workpiece W1 to be impacted, and besides, when the user turns the trigger switch 52 on, the power is supplied to the electric motor 15, so that the driving shaft 45 and the first gear 88 rotate clockwise in FIG. 12. In the clockwise rotation of the first gear 88, the second gear 90 rotates counterclockwise. During a period in which at least one of the three cam rollers 93 engages with the engagement unit 97, the striking unit 79 elevates against the urging force of the spring 82. In the counterclockwise rotation of the second gear 90, the third gear 92 rotates clockwise, and the weight 81 drops during a period in which at least one of the two cam rollers 94 engages with the engagement unit 98.

Then, when all the cam rollers 93 release from the engagement units 97, the striking unit 79 is dropped by an elastic recovery force of the spring 82. All the cam rollers 94 release from the engagement units 98 in synchronization with this action, so that the weight 81 is elevated by an urging force of the spring 82. In this manner, since the striking unit 79 and the weight 81 move in opposite directions to each other, oscillation of the housing 11 can be suppressed.

In the course of the dropping of the striking unit 79, the driver blade 85 strikes the nail 55, so that the nail 55 is driven into the workpiece W1 to be impacted. After the driver blade 85 drives the nail 55 into the workpiece W1 to be impacted by using the elastic recovery force of the spring 82, the plunger 84 collides with the plunger bumper 87. The plunger bumper 87 absorbs a part of the kinetic energy of the striking unit 79. The weight 81 collides with the weight bumper 86, and the weight bumper 86 absorbs a part of the kinetic energy of the weight 81.

Although the electric motor 15 rotates even after the striking unit 79 strikes the nail 55, the striking unit 79 stops at the position at which it is in contact with the plunger bumper 87, such as the bottom dead point, during a period in which all the cam rollers 93 release from the engagement units 97. And, the weight 81 stops at the position at which it is in contact with the weight bumper 86, such as the top dead point, during a period in which all the cam rollers 94 release from the engagement units 98.

When the cam roller 93 engages with the engagement unit 97, the striking unit 79 elevates from the bottom dead point. When the cam roller 94 engages with the engagement unit 98, the weight 81 drops from the top dead point. Then, the control unit 73 stops the electric motor 15 when detecting the arrival of the striking unit 79 and the weight 81 at the idle position.

A feeding operation of the nail 55 by the power mechanism 19 will be described with reference to FIGS. 5, 6 and 10. When the striking unit 79 stops at the idle position, the nail 55 is not positioned at the injection path 37. By the clockwise rotation of the first gear 88 in FIG. 12 in the state of the stoppage of the striking unit 79 at the idle position, the torque of the first gear 88 is transmitted to the rotational shaft 58 through the gear 101 and the bevel gears 102 and 103. Here, a rotational direction of the rotational shaft 58 shown in FIGS. 5, 6 and 10 is a clockwise direction that is the same as that of the first practical example.

When the striking unit 79 elevates from the idle position, the rotational shaft 58 rotates clockwise in FIG. 5, so that the feeder 62 moves in the second direction B2. Before the arrival of the striking unit 79 at the top dead point, all the engagement units 67 go away from the engagement units 69. Therefore, the feeder 62 moves in the first direction B1 as shown in FIG. 6, so that the feeder 62 feeds one nail 55 to the injection path 37. Then, when the piston 60 is in contact with the end surface 78 in FIG. 11, the feeder 62 stops.

Further, after the arrival of the striking unit 79 at the top dead point by the rotation of the first gear 88, the striking unit 79 drops from the top dead point toward the bottom dead point, and the striking unit 79 stops at the bottom dead point. During a period of the dropping of the striking unit 79 from the top dead point to the bottom dead point, the rotational shaft 58 rotates clockwise in FIG. 6. However, all the engagement units 67 release from the engagement units 69, so that the feeder 62 stops.

After the arrival of the striking unit 79 at the top dead point, when the cam roller 93 engages with the engagement unit 97 so that the striking unit 79 elevates from the top dead point, the engagement unit 67 engages with the engagement unit 69 as shown in FIG. 10. Therefore, the feeder 62 is moved in the second direction B2 by the torque of the rotational shaft 58. Then, when the electric motor 15 stops after the arrival of the striking unit 79 at the idle position, the rotational shaft 58 stops at the position of FIG. 5.

Also in the driver 10 of the second practical example, a relation between the position of the striking unit 79 and the timing of the feeding of the nail 55 to the injection path 37 by the power mechanism 19 can be designed. For example, the relation between the position of the striking unit 79 and the timing of the feeding of the nail 55 to the injection path 37 by the power mechanism 19 can be designed by change of the position of the cam roller 93 in the rotational direction of the second gear 90. And, the relation between the position of the striking unit 79 and the timing of the feeding of the nail 55 to the injection path 37 by the power mechanism 19 can be designed by change of the position of the engagement unit 67 in the rotational direction of the cam 64.

Therefore, the nail 55 can be fed to the injection path 37 during a period from the dropping of the striking unit 79 after the user's operation of the trigger 51 to the arrival thereof at a position that allows the driver blade 85 to strike the nail 55. In other words, the nail 55 can be fed to the injection path 37 at any of a moment before the arrival of the striking unit 79 at the top dead point, a moment of the arrival of the striking unit 79 at the top dead point, and a moment of the dropping of the striking unit 79.

Third Practical Example

Figure 13:
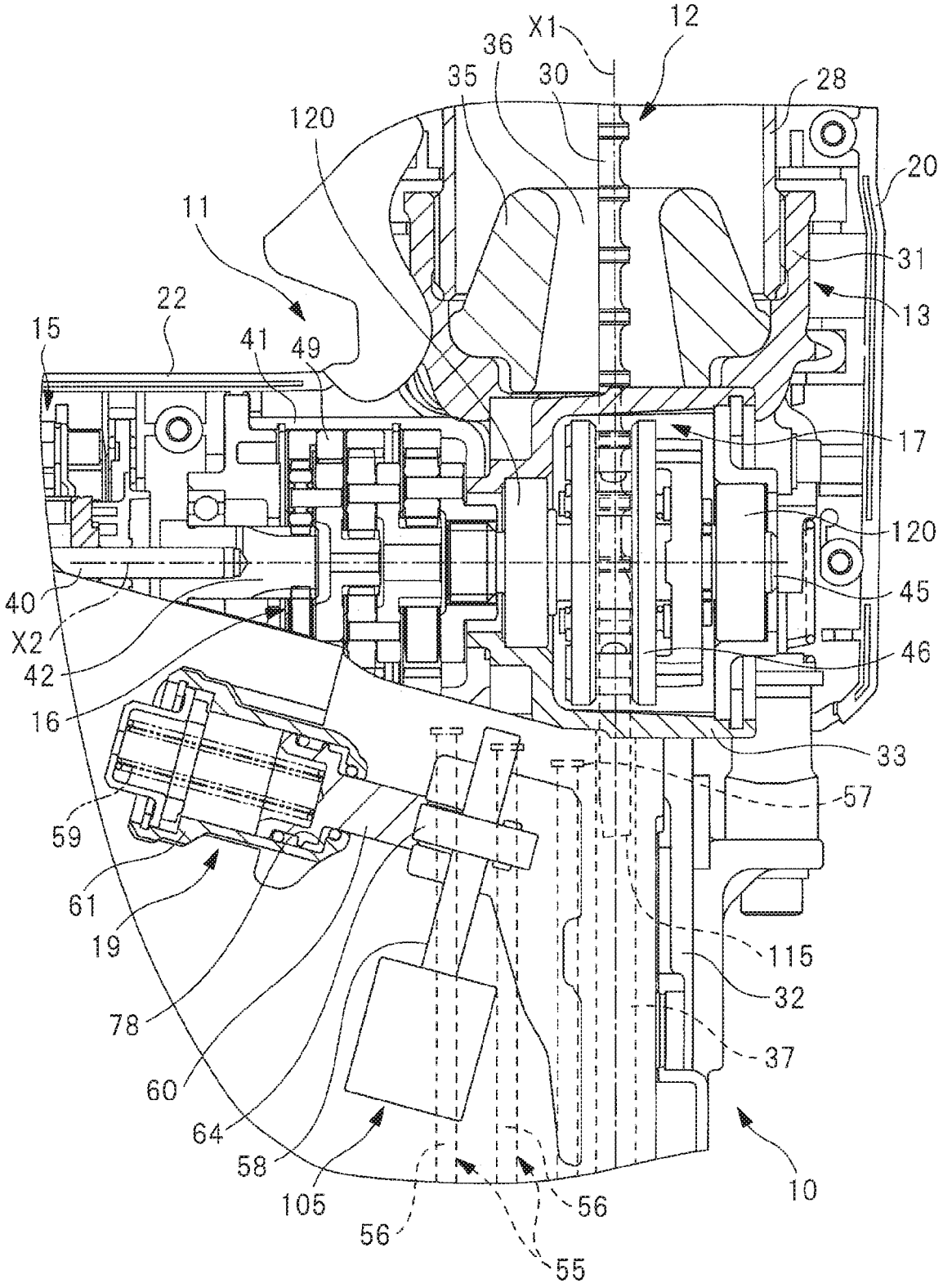
FIG. 13 is a partial cross-sectional view showing a third practical example of the driver.

FIG. 13 shows a third practical example of the driver 10. In the driver 10 of FIG. 13, the same components as those of FIGS. 1 and 2 are denoted with the same reference symbols as those of FIGS. 1 and 2. The power mechanism 19 includes an electric motor 105, and the electric motor 105 rotates and stops the rotational shaft 58. The electric motor 105 can rotate the rotational shaft 58 clockwise in FIGS. 5, 6 and 10. As shown in FIG. 4, the power of the power supply unit 14 can be supplied to the electric motor 105. The control unit 73 controls the rotation and the stoppage of the electric motor 105.

The driver 10 of FIG. 13 has the same behavior and function as those of the driver 10 of FIGS. 1 and 2. The control unit 73 can feed the nail 55 to the injection path 37 by rotating and stopping the rotational shaft 58 by using the torque of the electric motor 105. The driver 10 of FIG. 13 can have the same relation between the position of the striking unit 12 and the timing of the feeding of the nail 55 to the injection path 37 as that of the driver 10 of FIGS. 1 and 2.

The electric motor 105 of FIG. 13 is a physically different component from the electric motor 15, and the torque of the electric motor 15 is not transmitted to the rotational shaft 58. Therefore, the rotational timing and the stoppage timing of the electric motor 105 by the control unit 73 can be designed to be different from the rotational timing and the stoppage timing of the electric motor 15. That is, the nail 55 can be fed to the injection path 37 at any of a moment before the arrival of the striking unit 12 at the top dead point, a moment of the arrival of the striking unit 12 at the top dead point, and a moment during a period from the movement of the striking unit 12 from the top dead point to the arrival thereof at a position that allows the striking unit to strike the nail 55.

Fourth Practical Example

Figure 14:
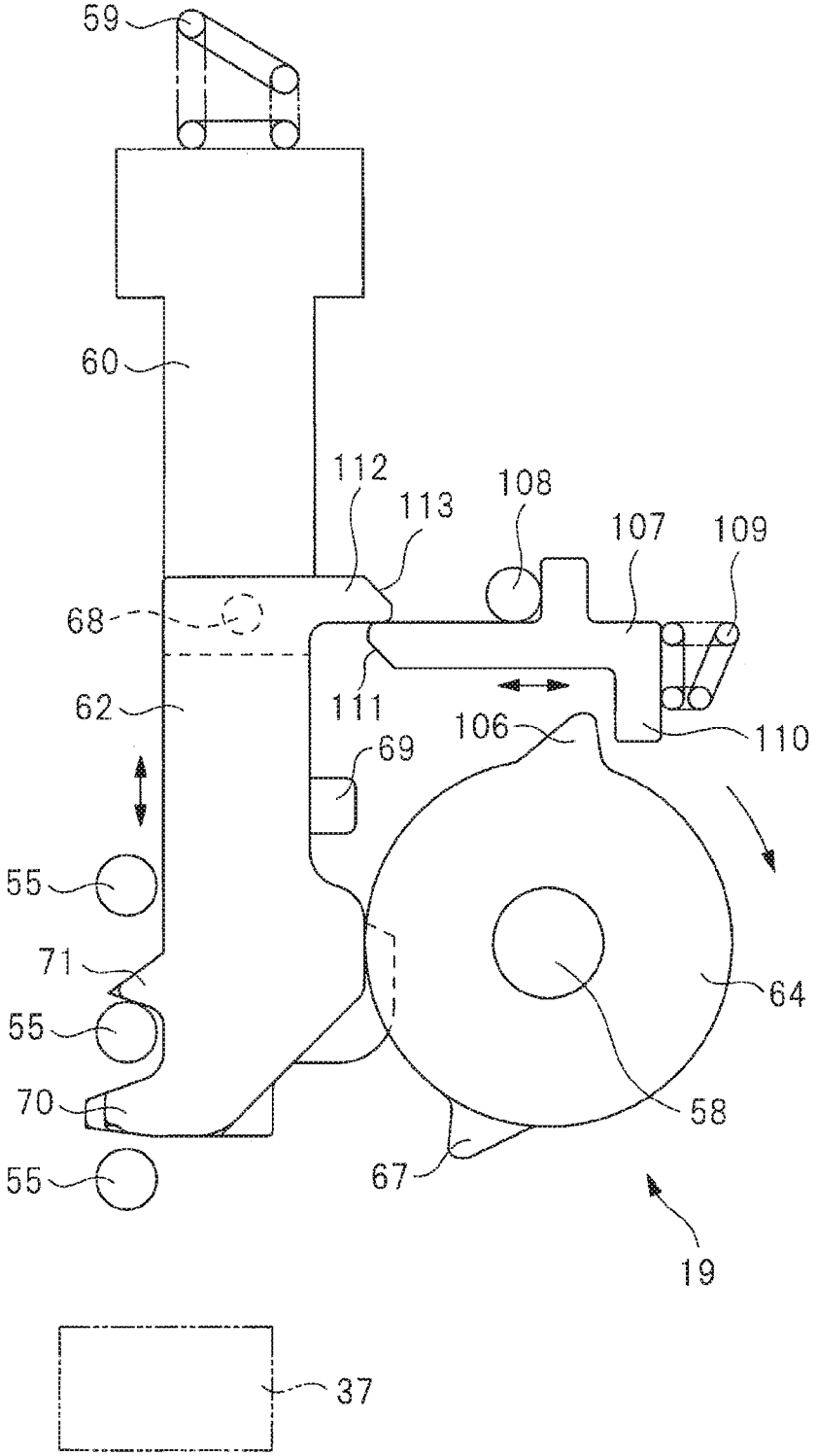
FIG. 14 is a bottom view showing a fourth practical example of the power mechanism provided in the driver.

A fourth practical example is another example of the power mechanism, and the power mechanism 19 will be described with reference to FIG. 14. The power mechanism 19 of FIG. 14 is applicable to both the driver 10 of the first practical example and the driver 10 of the second practical example. The power mechanism 19 of FIG. 14 includes an engagement unit 106, a regulating member 107, a stopper 108 and a spring 109. The engagement unit 106 is provided at the cam 64. The engagement unit 106 is provided at a position that is different from that of the engagement unit 67 in the rotational direction of the cam 64. The regulating member 107 is provided at the magazine 54 so that the regulating member 107 can reciprocate in a direction crossing the movement direction of the feeder 62.

The spring 109 urges the regulating member 107 in a direction coming close to the feeder 62. The stopper 108 is provided at the magazine 54 shown in FIG. 2 or 11. The regulating member 107 that is urged by the spring 109 is in contact with and stops at the stopper 108. Further, at the regulating member 107, an engagement unit 110 and a guide surface 111 are provided. The engagement unit 106 can engage with and release from the engagement unit 110. The guide surface 111 is a flat surface that tilts from the movement direction of the regulating member 107.

The engagement unit 112 is provided at the feeder 62, and the engagement unit 112 has a guide surface 113. The guide surface 113 is a flat surface that tilts from the movement direction of the feeder 62. The guide surface 111 and the guide surface 113 are parallel to each other.

Next, the operation of the power mechanism 19 shown in FIG. 14 will be described with reference to FIGS. 14 to 19. Here, an example of the feeding of the nail 55 to the injection path 37 in accordance with the position of the striking unit 12 shown in FIG. 2 will be described. When the striking unit 12 stops at the idle position as shown in FIG. 3, the regulating member 107 is urged by the urging force of the spring 109, and is in contact with and stops at the stopper 180 as shown in FIG. 14. The regulating member 107 engages with the engagement unit 112, and the feeder 62 stops at a position that is the farthest from the injection path 37. That is, when the striking unit 12 stops at the idle position, the nail 55 is not fed to the injection path 37. And, the engagement unit 67 releases from the engagement unit 69.

Figure 15:
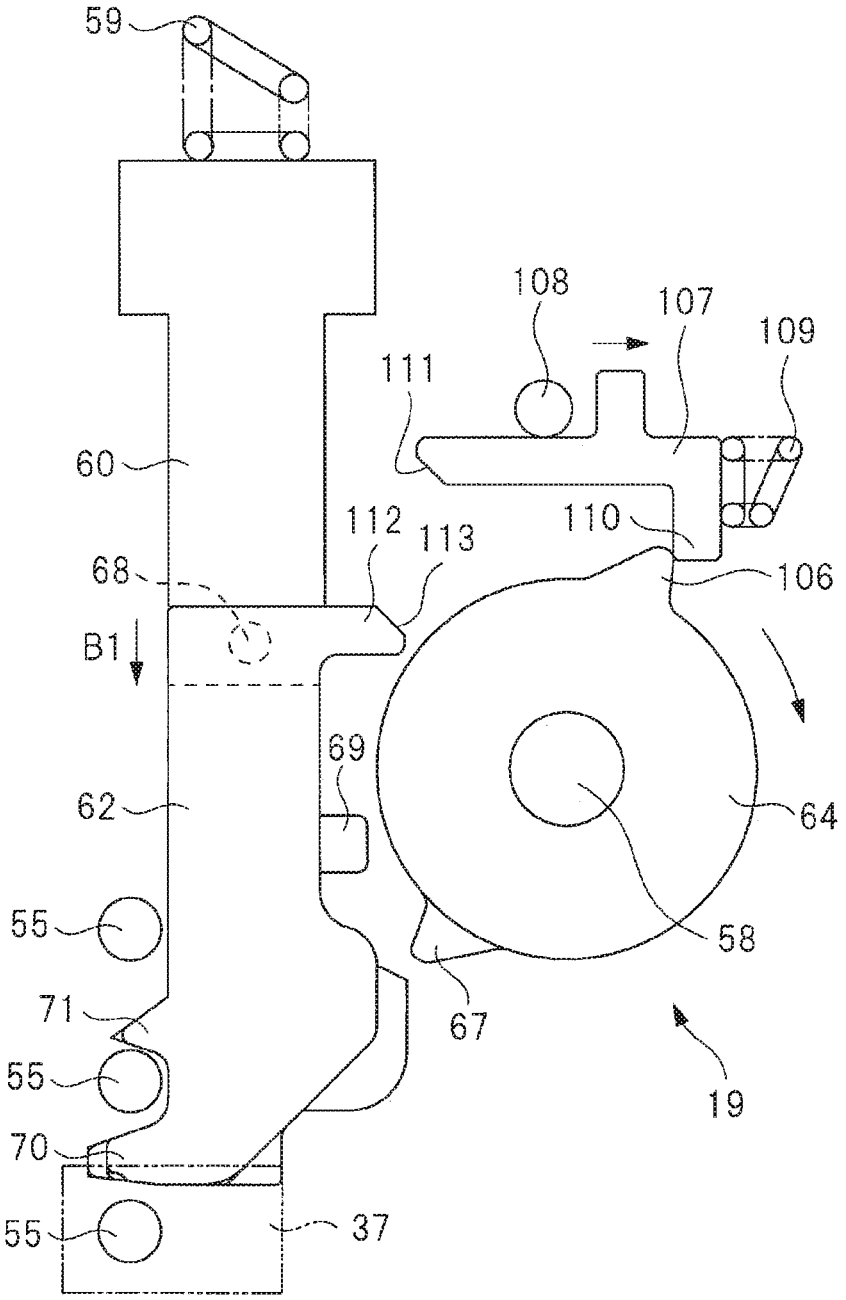
FIG. 15 is a bottom view showing motion of the power mechanism of FIG. 14.

By the rotation of the electric motor 15 to elevate the striking unit 12 from the idle position of FIG. 3, the rotational shaft 58 is rotated clockwise in FIG. 14, and the engagement unit 106 engages with the engagement unit 110. Then, the regulating member 107 moves in a direction going away from the feeder 62 against the urging force of the spring 109. By the movement of the regulating member 107 to release the regulating member 107 from the engagement unit 112, the feeder 62 is moved in the first direction B1, so that the feeder 62 feeds one nail 55 to the injection path 37 as shown in FIG. 15. The feeder 62 is in contact with and stops at the end surface 78. The engagement unit 67 is released from the engagement unit 69.

Figure 16:
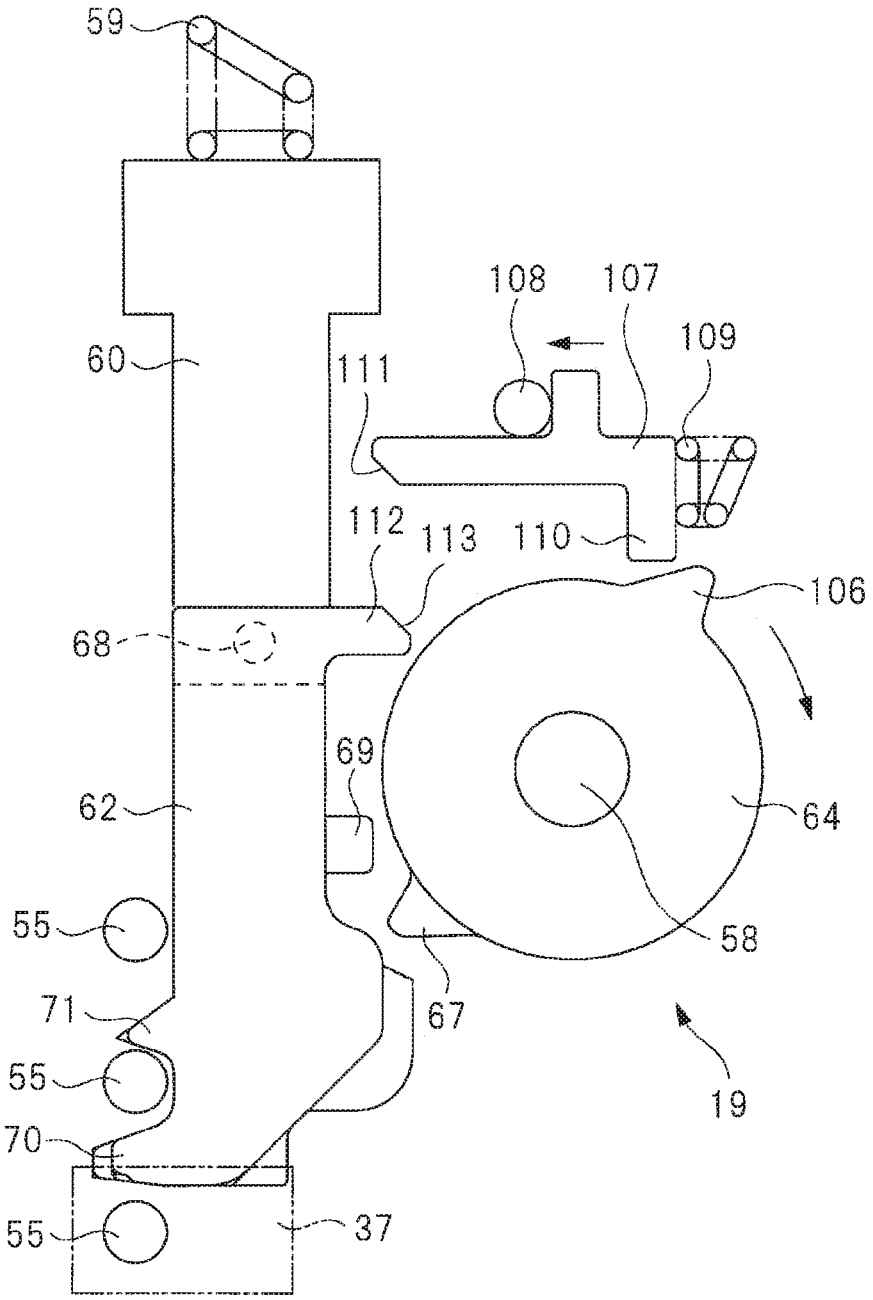
FIG. 16 is a bottom view showing motion of the power mechanism of FIG. 14.

Further, by the arrival of the striking unit 12 at the top dead point as shown in FIG. 7, the engagement unit 106 is released from the engagement unit 110 as shown in FIG. 16. Therefore, the regulating member 107 is moved by the urging force of the spring 109, and is in contact with and stops at the end surface 108. The engagement unit 67 is released from the engagement unit 69, and the feeder 62 is in contact with and stops at the end surface 78.

Further, during a period from the striking of the nail 55 by the driver blade 30 by the dropping of the striking unit 12 from the top dead point to the arrival of the striking unit 12 at the bottom dead point, the engagement unit 106 releases from the engagement unit 110, and the engagement unit 67 releases from the engagement unit 69. Therefore, the feeder 62 stops.

Figure 17:
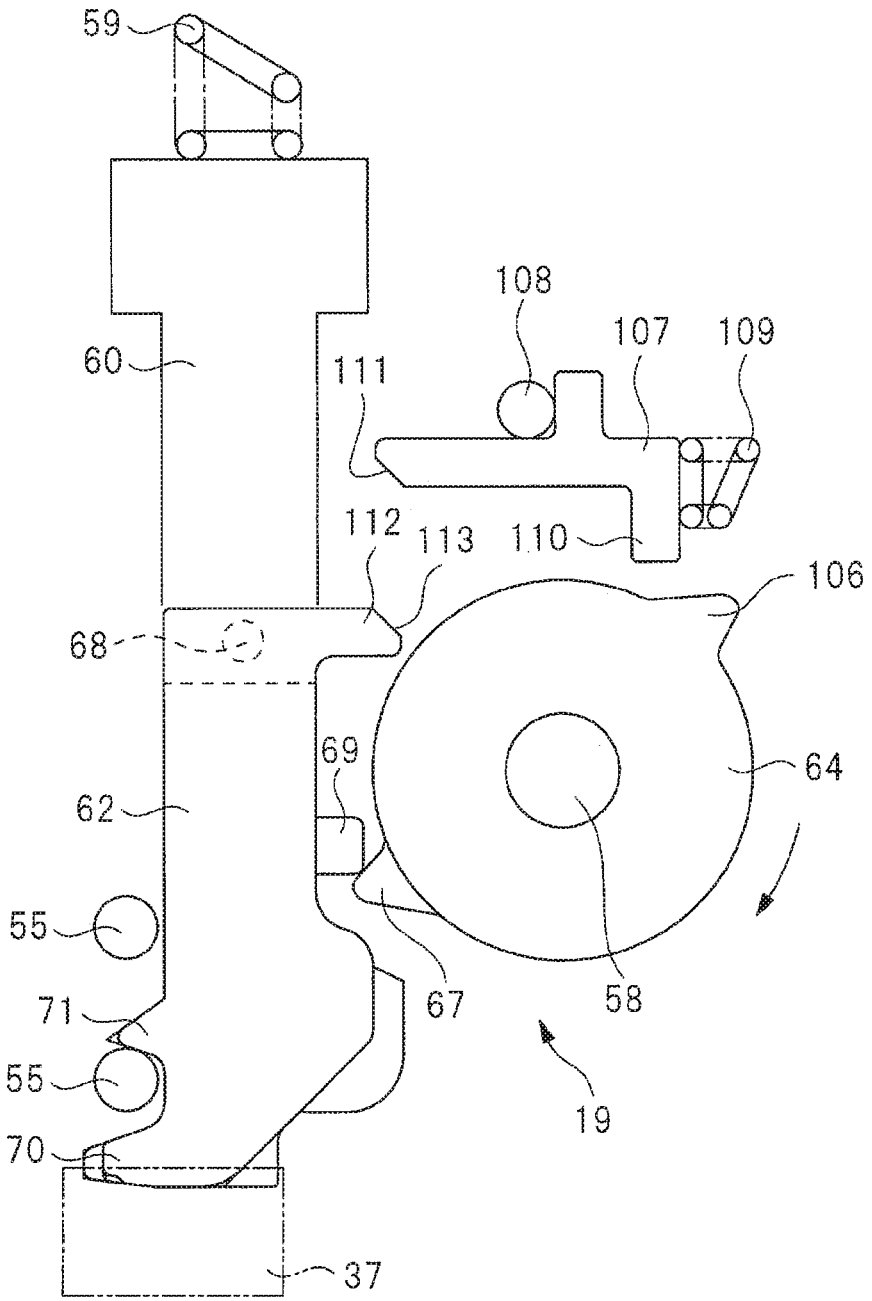
FIG. 17 is a bottom view showing motion of the power mechanism of FIG. 14.
Figure 18:
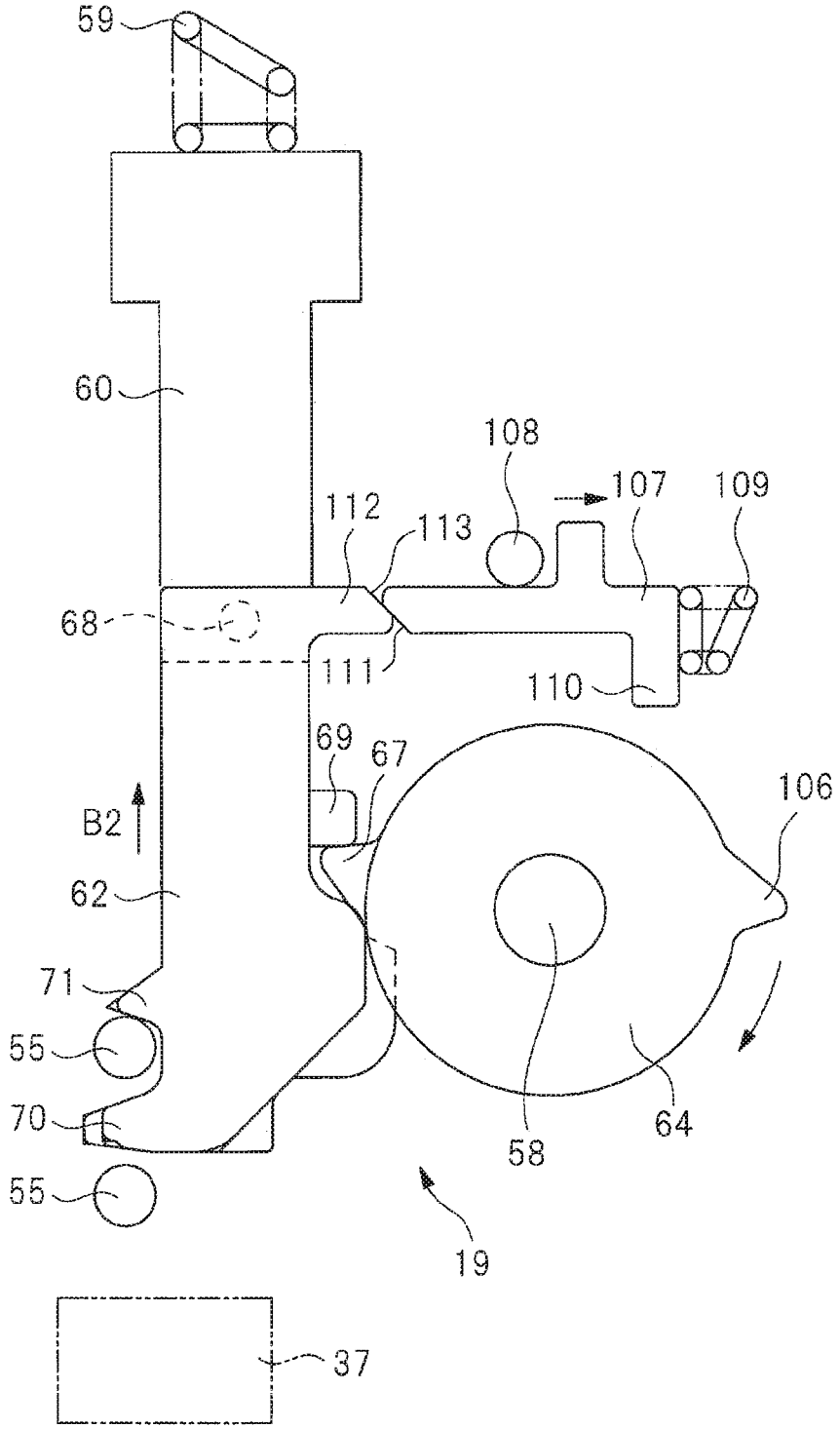
FIG. 18 is a bottom view showing motion of the power mechanism of FIG. 14.

Further, the rotation of the electric motor 15 is kept to elevate the striking unit 12 from the bottom dead point, and the rotational shaft 58 rotates, so that the engagement unit 67 engages with the engagement unit 69 as shown in FIG. 17. Then, as shown in FIG. 18, the feeder 62 moves in the second direction B2. When the guide surface 113 is in contact with the guide surface 111, a component force caused by the movement of the feeder 62 is transmitted to the regulating member 107. Then, the regulating member 107 moves in a direction going away from the feeder 62 against the urging force of the spring 109.

Figure 19:
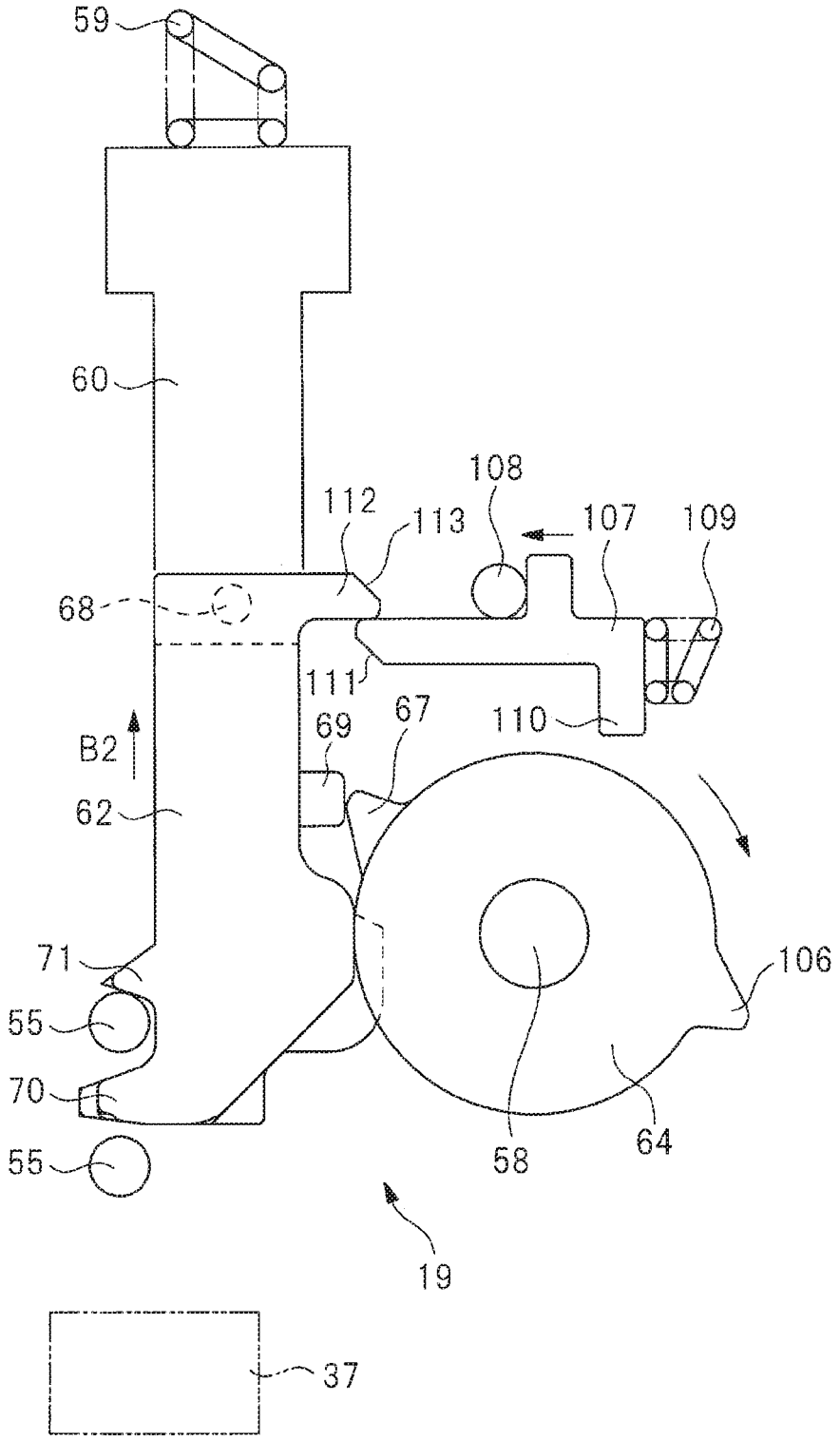
FIG. 19 is a bottom view showing motion of the power mechanism of FIG. 14.

Then, before the arrival of the striking unit 12 at the idle position, the regulating member 107 rides over the engagement unit 112, and the regulating member 107 is brought close to the feeder 62 by the urging force of the spring 109. Therefore, as shown in FIG. 19, the regulating member 107 engages with the engagement unit 112, and the engagement unit 67 releases from the engagement unit 69, so that the feeder 62 stops. Then, by the arrival of the striking unit 12 at the idle position as shown in FIG. 3, the electric motor 15 is stopped, and the feeder 62 is stopped at the position in FIG. 14.

The power mechanism 19 of the fourth practical example can change a timing of the engagement of the regulating member 107 with the engagement unit 112 by setting the position of the engagement unit 106 in the rotational direction of the cam 64. Thus, in accordance with the position of the striking unit 12, the timing of the feeding of the nail 55 to the injection path 37 can be changed. Therefore, the nail 55 can be fed to the injection path 37 at any of a moment before the arrival of the striking unit 12 at the top dead point, a moment of the arrival of the striking unit 12 at the top dead point, and a moment during a period from the movement of the striking unit 12 from the top dead point to the arrival thereof at a position that allows the striking unit to strike the nail 55.

During a period of the stoppage of the striking unit at the bottom dead point, the power mechanism 19 of FIGS. 14 to 19 moves the feeder 62 against the urging force of the spring 59 by using the torque of the rotational shaft 58. Therefore, a period in which a torque loads on the electric motor 15 for the movement of the feeder 62 and a period in which a torque loads on the electric motor 15 for the elevation of the striking unit 12 do not overlap each other, so that the maximum torque of the electric motor 15 can be reduced. Therefore, the electric motor 15 can be downsized or get lighter. Further, a respondent performance in the elevation of the striking unit 12 is improved.

Further, the feeder 62 feeds the nail 55 to the injection path 37 by using the urging force of the spring 59. Therefore, the elastic force of the spring 59 is set to have an appropriate amount, so that the nail 55 can be fed to the injection path 37 to be faster in the structure of the present embodiment than a structure in which the feeder is operated by the power of the electric motor 15 to feed the nail to the injection path. Therefore, the respondent performance of the power mechanism 19 can be improved, and the timing of the feeding of the nail 55 to the injection path 37 can be finely set.

When the driver 10 of FIG. 11 is provided with the power mechanism 19 of FIG. 14, note that the timing of the feeding of the nail 55 to the injection path 37 can be changed in accordance with the position of the striking unit 79.

Fifth Practical Example

Figure 20:
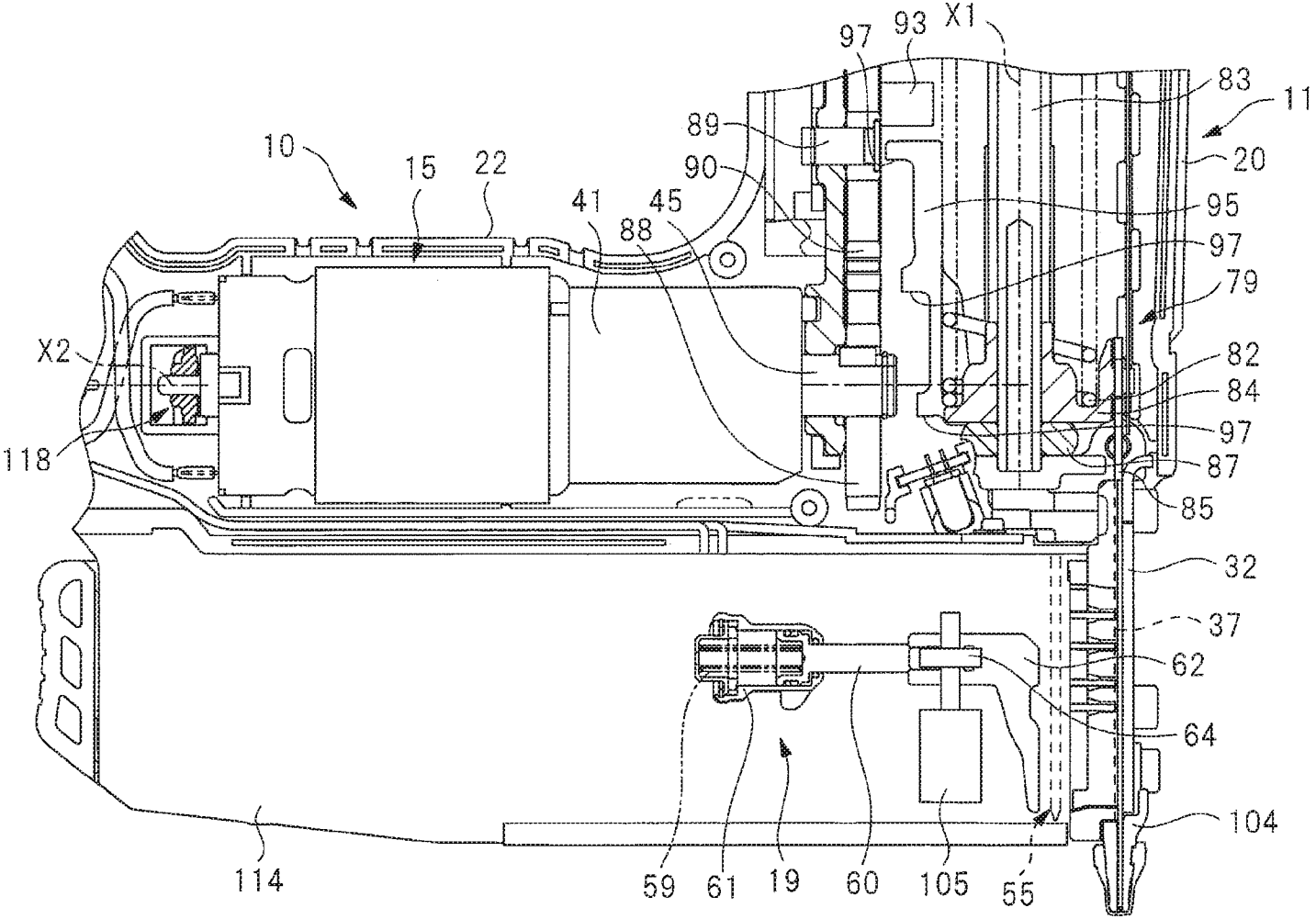
FIG. 20 is a partial cross-sectional view showing a fifth practical example of the driver.

FIG. 20 shows a fifth practical example of the driver 10. The driver 10 of FIG. 20 includes the striking unit 79, the driving mechanism 80, the weight 91, the spring 82, the plunger bumper 87 and the weight bumper 86 as similar to the driver 10 of FIG. 11. The magazine 114 of FIG. 20 has a guide slot that houses the plurality of nails 55 so that the nails are linearly arranged on one line. The power mechanism 19 of FIG. 20 is configured as similar to the third practical example of FIG. 13.

In the driver 10 of FIG. 20, the rotation regulating mechanism 118 is provided inside the motor case 22. The rotation regulating mechanism 118 allows the electric motor 15 to rotate when the torque of the electric motor 15 is transmitted to the driving shaft 45, and prevents the electric motor 15 from rotating by using the torque transmitted from the second gear 90 to the driving shaft 45.

In the driver 10 of FIG. 20, the electric motor 15, the electric motor 105, the driving mechanism 80, the weight 81 and the spring 82 function as similar to the electric motor 15, the electric motor 105, the driving mechanism 80, the weight 81 and the spring 82 shown in FIG. 13, respectively. The power mechanism 19 shown in FIG. 20 functions as similar to the power mechanism 19 shown in FIG. 13, and can obtain the same effect as similar to that of the power mechanism 19 shown in FIG. 13. In place of the power mechanism 19 shown in FIG. 20, note that the power mechanism 19 shown in FIG. 11 can be also used. That is, the power mechanism 19 can be configured so that the torque of the first gear 88 shown in FIG. 20 is transmitted to the rotational shaft 58 through the gear 101 and the bevel gears 102 and 103.

Figure 21:
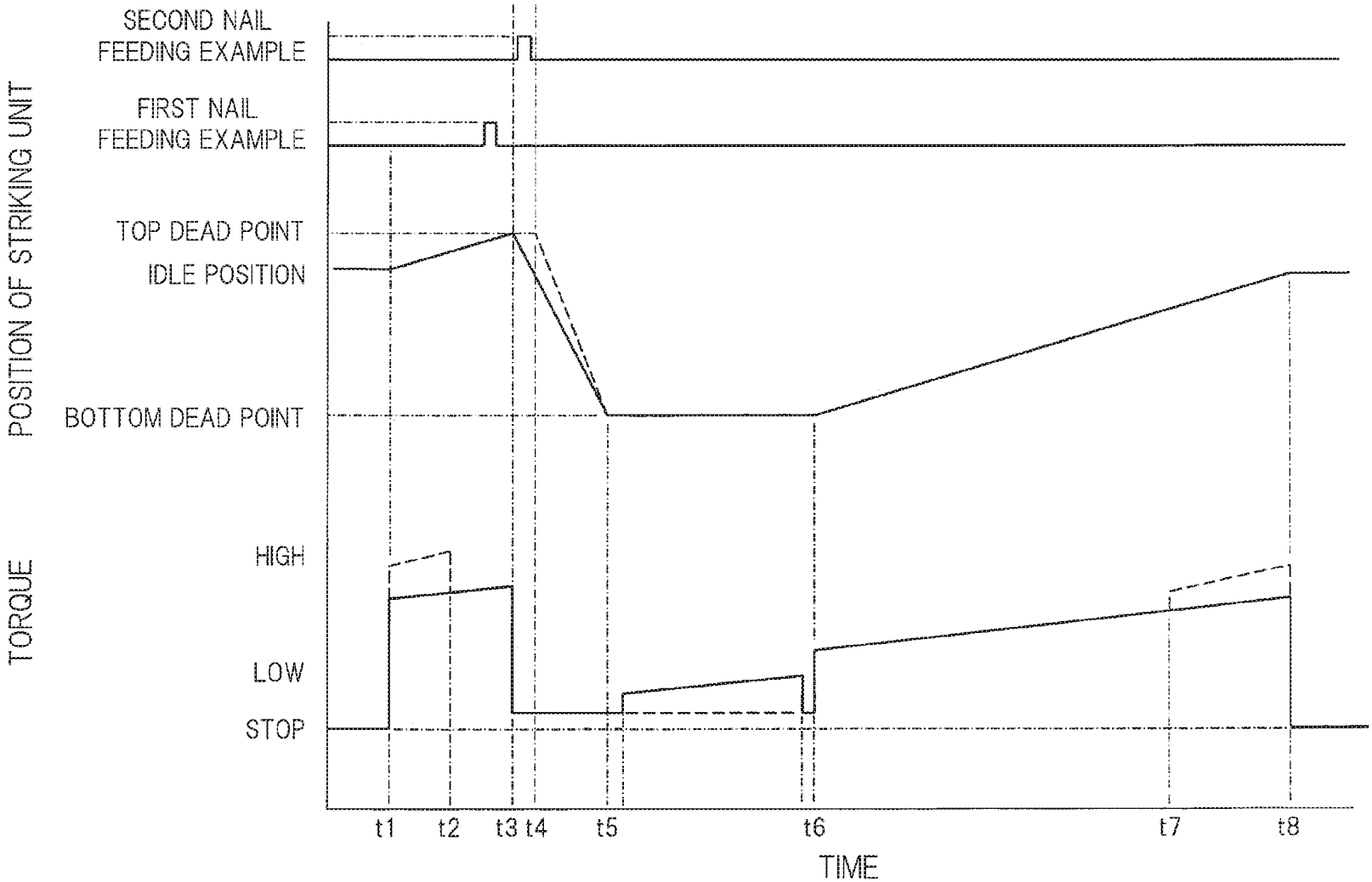
FIG. 21 is a time chart showing a relation between a position of a striking unit of the driver and a torque of an electric motor.

FIG. 21 shows a time chart showing a relation among the position of the striking unit, the nail feeding timing and the torque of the electric motor. First, the power mechanism of the fourth practical example will be described as an example. Before time "t1", at least either one of the trigger switch and the push switch is turned off, so that the electric motor stops, and the striking unit stops at the idle position. The trigger switch and the push switch are turned on at the time t1, the torque of the electric motor increases as shown with a solid line, so that the striking unit elevates from the idle position. The striking unit arrives at the top dead point at time "t3", and then, the striking unit drops toward the bottom dead point as shown with a solid line, so that the torque of the rotating electric motor decreases. As shown in a first nail feeding example, the nail is fed to the injection path during a period from the time t1 to the arrival at the time t3.

Further, the striking unit arrives and stops at the bottom dead point at time "t5", and the striking unit starts the elevation at time "t6". The power mechanism of the fourth practical example moves the feeder against the urging force of the spring by using the torque of the electric motor during a period from the time t5 to the time t6 in which the striking unit stops. Therefore, the torque of the electric motor increases and decreases during the period from the time t5 to the time t6.

Then, at the time t6, the striking unit starts to elevate form the bottom dead point toward the idle position, and the torque of the electric motor increases. With the approach of the striking unit to the idle position, the torque loaded on the electric motor increases. Further, when the striking unit arrives at the idle position at time "t8", the electric motor stops.

In the examples of the power mechanisms of the first to third and fifth practical examples, the torque of the electric motor will be described. During a period of the movement of the striking unit from the idle position toward the top dead point, the feeder is moved against the urging force of the spring by the torque of the electric motor. Therefore, the torque of the electric motor increases, and then, decreases during, for example, a period from the time t1 to the time t2 as shown with a broken line.

When the striking unit stops at the bottom dead point during the period from the time t5 to the time t6, the feeder stops, and therefore, the torque of the electric motor during the period from the time t5 to the time t6 is the same as that during a period from the time t3 to the time t5 as shown with a broken line.

Further, the feeder is moved against the urging force of the spring by the torque of the electric motor during a period from the start of the elevation of the striking unit at the time t6 to the arrival thereof at the idle position at time "t8". Therefore, for example, during a period from time "t7" to the time t8, the torque of the electric motor increases as shown with a broken line.

Next, a second nail feeding example that is equivalent to the case of the elevation of the striking unit by using the cam roller 93 in FIG. 12 as described in the second and fifth practical examples will be described. When a shape of the outer circumferential surface of the cam roller 93 is formed so as to follow an outer diameter of the second gear 90, stoppage of the striking unit at the idle position can be achieved for predetermined time. For example, stoppage of the striking unit at the idle position can be achieved during a period from the time t3 to the time t4 in the time chart of FIG. 21. And, the nail can be fed to the injection path during the period from the time t3 to the time t4. The timing of the feeding of the nail to the injection path can be changed by the setting of the position of the engagement unit 67 in the rotational direction of the cam 64. In this case, the torque of the electric motor is kept constant during the period from the time t3 to the time t4, and starts to decrease at the time t4.

The power mechanism 19 may include a solenoid 117 shown in FIG. 4 in place of the electric motor 105. The feeder 62 is made of a magnetic material, so that an excitation current can be supplied to and cut from the solenoid 117. The control unit 73 controls the solenoid 117 to supply an electromagnetic current to the solenoid 117, so that the feeder 62 is moved against the urging force of the spring 59 by a magnetic attractive force generated by the solenoid 117.

The meaning of the terms described in the present embodiment will be described. The nail 55 is one example of a fastener, each of the injection unit 32 and the top dead point is one example of a first position, and the bottom dead point is one example of a second position. Each of the striking units 12 and 79, the driver 10, the trigger 51, the push lever 72 and the pressing member 104 is one example of an operational member. Each of the pressure chamber 27, the spring 82, the electric motor 15, the pin wheel 46 and the driving mechanism 80 is one example of a moving mechanism.

Each of the pressure chamber 27 and the spring 82 is one example of a first moving unit, and each of the electric motor 15, the pin wheel 46 and the driving mechanism 80 is one example of a second moving unit. The electric motor 15 is one example of a first motor.

The electric motor 105 is one example of a second motor. The regulating member 107 is one example of an energy storage unit, and each of the rotation regulating mechanisms 49 and 118 is one example of a holding mechanism. The striking position of the striking unit 12 is a position immediately previous to arrival of a tip end 115 of the driver blade 30 at the head portion 57 of the nail 55 in the injection path 37 or a position immediately previous to arrival of a tip end 116 of the driver blade 85 at the head portion 57 of the nail 55 in the injection path 37.

The driver is not limited to the foregoing embodiments, and various modifications can be made within the scope of the present invention. For example, the conversion mechanism includes a rack and pinion mechanism, a cam mechanism, and a traction mechanism. The cam mechanism includes a cam plate that is rotated by a torque of a motor, a cam surface formed on the cam plate, and a slide that moves along the cam surface and is attached to the striking unit. The traction mechanism includes a rotational component that is rotated by the torque of the motor, and a cable that pulls the striking unit while being wound around the rotational component.

The driver includes one that screws the fastener into the workpiece to be impacted by striking and rotating a screw serving as the fastener. This driver case may have either a structure in which a driving source for the striking mechanism that strikes the fastener, a driving source for applying the torque to the fastener and a driving source for feeding the fastener to the injection path are separately provided, or a structure in which the driving sources are shared.

Types of the motor serving as a power source that moves the striking unit include not only the electric motor but also an engine, a hydraulic motor and a pneumatic motor. The electric motor may be a brushed motor or a brushless motor. The driver may be a driver that accumulates a rotational energy of the motor into a flywheel and moves the striking unit by using the rotational energy of the flywheel in a stoppage state of the motor. The driver that moves the striking unit by using the torque of the flywheel is described in, for example, Japanese Patent Application Laid-open Publication No. 2007-216339 and Japanese Patent Application Laid-open Publication No. 2007-118170. Types of the fastener include not only a bar-shaped nail but also a bar-shaped needle and a U-shaped metallic piece.

Types of the power supply unit that supplies the power to the electric motor include a direct-current power supply and an alternate-current power supply. Types of the direct-current power supply include a primary battery and a secondary battery. Types of the power supply unit includes an adaptor connected to the direct-current power supply or the alternate-current power supply through a power cable.

EXPLANATION OF REFERENCE CHARACTERS

10 . . . driver, 11 . . . housing, 12 and 79 . . . striking unit, 15 and 105 . . . electric motor, 17 . . . converting mechanism, 19 . . . power mechanism, 27 . . . pressure chamber, 32 . . . injection unit, 46 . . . pinwheel, 49 and 118 . . . rotation regulating mechanism, 51 . . . trigger, 54 and 114 . . . magazine, 55 . . . nail (fastener), 62 . . . feeder, 72 . . . push lever, 80 . . . driving mechanism, 82 . . . spring, 104 . . . pressing member, 107 . . . regulating member, 117 . . . solenoid, B1 . . . first direction, B2 . . . second direction

The invention claimed is:

1. A driver comprising:

an injection unit to which a fastener is fed;

a striking unit operable to strike the fastener of the injection unit when moving from a first position to a second position;

an operational member operated by an operator;

a feeder operable to move in a first direction toward the injection unit to feed the fastener to the injection unit and move in a second direction away from the injection unit when the operational member is operated;

an urging member configured to urge the feeder in the first direction;

a power mechanism configured to move the feeder in the second direction against the urging member urging the feeder in the first direction, hold the feeder at a third position after moving the feeder in the second direction, and release the feeder held at the third position, wherein (1) the feeder moves in the first direction by the urging member to feed the fastener to the injection unit during a period from the operation of the operational member to a moment before the striking unit strikes the fastener so that the striking unit strikes the fastener, (2) after the feeder feeds the fastener to the injection unit, the power mechanism moves the feeder in the second direction and hold the feeder at the third position, and (3) the injection unit has no fastener after the striking unit strikes the fastener and before the feeder is released by the power mechanism.

2. The driver according to claim 1, further comprising a moving mechanism to stop and move the striking unit, wherein the moving mechanism includes:

a first moving unit configured to move the striking unit from the first position to the second position; and a second moving unit configured to move the striking unit against a force applied to the striking unit from the first moving unit from the second position to the first position.

3. The driver according to claim 2, wherein the second moving unit includes a converting mechanism configured to convert a torque of the first motor into a force that moves the striking unit from the second position to the first position.

4. The driver according to claim 2, wherein the first moving unit moves the striking unit by using a pressure of gas.

5. The driver according to claim 2, wherein the first moving unit moves the striking unit by using an elastic recovery force of an elastic member.

6. The driver according to claim 1, wherein, after the striking unit strikes the fastener but before the moving mechanism moves the striking unit from the second position to the first position, the feeder moves in the second direction.

7. The driver according to claim 1 further comprising:

a holding mechanism configured to stop the striking unit at an idle position between the first position and the second position, wherein a tip end of the striking unit stopped at the idle position is positioned between a head portion of the fastener and a tip end of the fastener at the closest position to the injection unit, and the moving mechanism moves the striking unit stopped at the idle position to the first position when the operational member is operated.

8. The driver according to claim 1, wherein the power mechanism includes a solenoid.

9. A driver comprising:

an injection unit to which a fastener is fed; and a striking unit operable to stop and move between a first position and a second position and operable to strike the fastener of the injection unit when moving from the first position to the second position, wherein the driver further includes:

an operational member operated by an operator;

a moving mechanism having a first motor and configured to stop and move the striking unit when the operational member is operated;

a feeder operable to move in a first direction toward the injection unit to feed the fastener to the injection unit and move in a second direction away from the injection unit;

an urging member configured to urge the feeder in the first direction;

a power mechanism, operated by the first motor, configured to move the feeder in the second direction against the urging member urging the feeder in the first direction, hold the feeder at a third position after moving the feeder in the second direction, and release the feeder held at the third position, wherein (1) the feeder moves in the first direction by the urging member to feed the fastener to the injection unit during a period from start of the movement of the striking unit by the operation of the operational member to a moment before the striking unit strikes the fastener, (2) after the feeder feeds the fastener to the injection unit, the power mechanism moves the feeder in the second direction and hold the feeder at the third position during a period of stoppage of the striking unit, and (3) the injection unit has no fastener after the striking unit strikes the fastener and before the feeder is released by the power mechanism.

10. The driver according to claim 9, wherein, when the striking unit moves and comes close to the first position, the feeder moves in the second direction.

11. A driver comprising:

an injection unit to which a fastener is fed; and a striking unit operable to reciprocate between a first position and a second position and operable to strike the fastener of the injection unit when moving from the first position to the second position, wherein the driver further includes:

an operational member operated by an operator;

a moving mechanism configured to move the striking unit when the operational member is operated;

a feeder operable to move in a first direction toward the injection unit to feed the fastener to the injection unit and move in a second direction away from the injection unit;

an urging member configured to urge the feeder in the first direction;

a power mechanism configured to move the feeder in the second direction against the urging member urging the feeder in the first direction, hold the feeder at a third position after moving the feeder in the second direction, and release the feeder held at the third position, wherein (1) the moving mechanism is configured to stop the striking unit at the first position, (2) the power mechanism feeds the fastener to the injection unit when the striking unit stops at the first position, (3) after feeding the fastener to the injection unit, the power mechanism moves the feeder in the second direction and hold the feeder at the third position, and (4) the injection unit has no fastener after the striking unit strikes the fastener and before the feeder is released by the power mechanism.

12. A driver comprising:

an injection unit to which a fastener is fed;

a striking unit operable to strike the fastener of the injection unit when moving from a first position to a second position;

an operational member operated by an operator;

a feeder operable to move in a first direction toward the injection unit to feed the fastener to the injection unit and move in a second direction away from the injection unit when the operational member is operated;

an urging member configured to urge the feeder in the first direction; and a power mechanism configured to move the feeder in the second direction against the urging member urging the feeder in the first direction, hold the feeder at a third position after moving the feeder in the second direction, and release the feeder held at the third position, wherein (1) the power mechanism releases the feeder held at the third position, and the feeder moves in the first direction by the urging member to feed the fastener to the injection unit, (2) after the feeder feeds the fastener to the injection unit, the power mechanism moves the feeder in the second direction and hold the feeder at the third position.

* * * * *